US007900911B2

(12) United States Patent
Ubayashi

(10) Patent No.: US 7,900,911 B2
(45) Date of Patent: Mar. 8, 2011

(54) IMAGE FORMING APPARATUS WITH WIDTH REGULATING MEMBER

(75) Inventor: Shinsuke Ubayashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 316 days.

(21) Appl. No.: 12/098,060

(22) Filed: Apr. 4, 2008

(65) Prior Publication Data

US 2008/0251996 A1 Oct. 16, 2008

(30) Foreign Application Priority Data

Apr. 12, 2007 (JP) ..... 2007-105365

(51) Int. Cl.
*B65H 1/00* (2006.01)

(52) U.S. Cl. ..... 271/171

(58) Field of Classification Search ..... 271/171, 271/145, 226, 238, 240, 207, 223; 399/393; 400/633, 633.1, 633.2; 270/58.12, 58.16, 270/58.17, 58.27; 74/31
See application file for complete search history.

(56) References Cited

U.S. PATENT DOCUMENTS

| | | | | |
|---|---|---|---|---|
| 6,254,086 | B1 * | 7/2001 | Sunou et al. | 271/171 |
| 6,804,473 | B2 | 10/2004 | Nakamura et al. | 399/16 |
| 2007/0212133 | A1 | 9/2007 | Uchida et al. | 399/329 |
| 2008/0265495 | A1 * | 10/2008 | Dobrindt | 271/226 |

FOREIGN PATENT DOCUMENTS

| | | | |
|---|---|---|---|
| JP | 9-110193 | A | 4/1997 |
| JP | 10-265060 | A | 10/1998 |

* cited by examiner

*Primary Examiner* — Stefanos Karmis
*Assistant Examiner* — Jeremy Severson
(74) *Attorney, Agent, or Firm* — Fitzpatrick, Cella, Harper & Scinto

(57) ABSTRACT

The present invention provides a sheet feeder apparatus in which a regulating member can securely be fixed without generating lateral slip of a sheet and an image forming apparatus. The regulating member regulates a sheet position in a width direction, and a fixing portion fixes the regulating member to a position according to a sheet size. The fixing portion includes plural rack gears which are provided in a surface opposite a surface abutting on the sheet of the regulating member; plural relay gears which engage the plural rack gears; a rotating shaft on which the plural relay gears are provided; and a lock mechanism which regulates rotation of the rotating shaft when the regulating member is moved away from the regulated sheet, the lock mechanism permitting the rotation of the rotating shaft when the regulating member is moved in a direction in which the regulating member contacts the regulated sheet.

6 Claims, 18 Drawing Sheets

IMAGE FORMING APPARATUS WITH WIDTH REGULATING MEMBER

BACKGROUND OF THE INVENTION

1. Field of the Invention

The present invention relates to an image forming apparatus, particularly to a configuration in which a regulating member regulating a position on a sheet width direction is fixed.

2. Description of the Related Art

Conventionally, a copying machine, a printer, and a facsimile can be cited as an example of the image forming apparatus forming an image on a sheet. The copying machine usually includes a function of scanning an original image to form the image on the sheet based on information on the scanned image. Recently some of the copying machines include a communication function to input the image information transmitted from the outside.

The printer forms the image on the sheet based on the image information usually transmitted from an external device such as a computer. The facsimile usually includes the function of scanning the original image and the communication function, the facsimile transmits the scanned image information to the outside, and the facsimile forms the image on the sheet based on the information transmitted from the outside.

In such pieces of image forming apparatus, a sheet feeder apparatus is disposed in a lower portion or a side face of an apparatus main body to feed the sheet from a sheet storage portion in which a large amount of sheets is stacked and stored, and the sheet feeder apparatus feeds the sheet to an image forming portion.

In the sheet feeder apparatus, a sheet feeder unit feeds the sheet from the sheet storage portion, and it is necessary to prevent sheet skew feeding or slip (lateral slip) in a direction orthogonal to a sheet feeding direction when the sheet is fed from the sheet storage portion.

Therefore, a side-end regulating member is provided in the sheet storage portion in order to regulate a position in a sheet width direction. The side-end regulating member can be moved in the width direction according to a size of the sheet accommodated in the sheet feeder apparatus (for example, see Japanese patent laid-Open Publication No. 10-265060).

FIG. 18 illustrates a configuration of a side-end regulating member provided in the conventional sheet storage portion, such as a sheet deck, in which the large amount of sheets is stored. A side-end regulating member 910 includes an abutment portion 910*a* abutting on a side end of the sheet, a fixing portion 910*b* extended in a horizontal direction from an upper end of the abutment portion 910*a*, and an insertion portion 910*c* extended downward from a lower end of the abutment portion 910*a*. In FIG. 18, aligning insertion holes 911 are made in a bottom 921 of a sheet storage portion 920 according to the sheet size.

In the case where the sheet having a different size is stored in the sheet storage portion 920, the insertion portion 910*c* of the side-end regulating member 910 is inserted into a predetermined insertion hole 911 made in the bottom 921 according to the size of the stored sheet. Then, the fixing portion 910*b* is fixed to the sheet storage portion 920 by a screw 912.

However, in such configurations, the change in position of the side-end regulating member 910 becomes troublesome, and improvement of operability is required. In order to improve the operability, there is proposed a configuration in which a side-end regulating member is provided in the opposite direction to press the side end of the sheet and the side-end regulating members are coupled with a gear and a rack.

In the sheet feeder apparatus including the side-end regulating member having the above-described configuration, after the pair of side-end regulating members is positioned according to the sheet size, it is necessary that the pair of side-end regulating members be locked so as not to be moved.

In an example of the lock unit, when the sheet storage portion is put into the body of the image forming apparatus, a ratchet cog is engaged with the rack gear to prevent slip such that the pair of side-end regulating members is not moved by impact of the weight of the stored sheets. Japanese patent laid-Open Publication No. 9-110193 proposes a technique in which the pair of side-end regulating members is fixed by a frictional force of a frictional member using a force generated in attaching the sheet storage portion to the body of the image forming apparatus.

However, in the conventional sheet feeder apparatus, when the ratchet cog is engaged with the rack gear to prevent the slip, the side-end regulating member can fixed only in each pitch of the rack gear. Therefore, the side-end regulating member slips up to one cog from the position where the side-end regulating member should be locked, which results in the generation of the lateral slip of the sheet.

In the technique in which the side-end regulating members are fixed by the frictional force of the frictional member using the force generated in attaching the sheet storage portion to the body of the image forming apparatus, a load is increased in attaching the sheet storage portion, which deteriorates the operability. When the frictional force is weakened with the operability paramount in thinking, the side-end regulating member slips easily in strongly attaching the sheet storage portion. Additionally, in the frictional member, because the frictional force is decreased by the influence of dirt (paper powder) or time deterioration, the side-end regulating member is hardly stably fixed.

SUMMARY OF THE INVENTION

The present invention provides an image forming apparatus in which the regulating member can surely be fixed without generating the lateral slip of the sheet.

In accordance with a first aspect of the invention, an image forming apparatus includes a sheet feeder apparatus including a sheet storage portion, the sheet storage portion including a regulating member and a fixing portion, the regulating member being provided to be able to be moved in a width direction orthogonal to a sheet feeding direction, the regulating member regulating a position of a sheet in the width direction, the fixing portion fixing the regulating member to a position according to a size of the sheet, the sheet feeder apparatus feeding the sheet whose position in the width direction is regulated by the regulating member, wherein the fixing portion includes plural rack gears which are provided in a surface opposite a surface abutting on the sheet of the regulating member, the rack gears extended in a moving direction of the regulating member; plural relay gears which engage the plural rack gears respectively; a rotating shaft on which the plural relay gears are provided; and a lock mechanism which regulates rotation of the rotating shaft when the regulating member is moved away from the regulated sheet, the lock mechanism permitting the rotation of the rotating shaft when the regulating member is moved in a direction in which the regulating member contacts the regulated sheet.

In accordance with a second aspect of the invention, an image forming apparatus includes a sheet feeder apparatus including a sheet storage portion, the sheet storage portion including a regulating member and a fixing portion, the regulating member being provided to be able to be moved in a width direction orthogonal to a sheet feeding direction, the regulating member regulating a position of a sheet in the width direction, the fixing portion fixing the regulating member to a position according to a size of the sheet, the sheet feeder apparatus feeding the sheet whose position in the width direction is regulated by the regulating member, wherein the fixing portion includes plural rack gears which are provided in a surface opposite a surface abutting on the sheet of the regulating member, the rack gears extended in a moving direction of the regulating member; plural relay gears which engage the plural rack gears respectively; a rotating shaft on which the plural relay gears are provided, the rotating shaft being moved according to movement of the regulating member; and a lock mechanism which regulates rotation of the rotating shaft so as to regulate both movement of the regulating member in a direction in which the regulating member is moved away from the regulated sheet and movement of the regulating member in a direction in which the regulating member contacts the regulated sheet.

Further features of the present invention will become apparent from the following description of exemplary embodiments (with reference to the attached drawings).

DESCRIPTION OF THE EMBODIMENTS

Exemplary embodiments of the invention will be described below with reference to the drawings.

Figure 1:
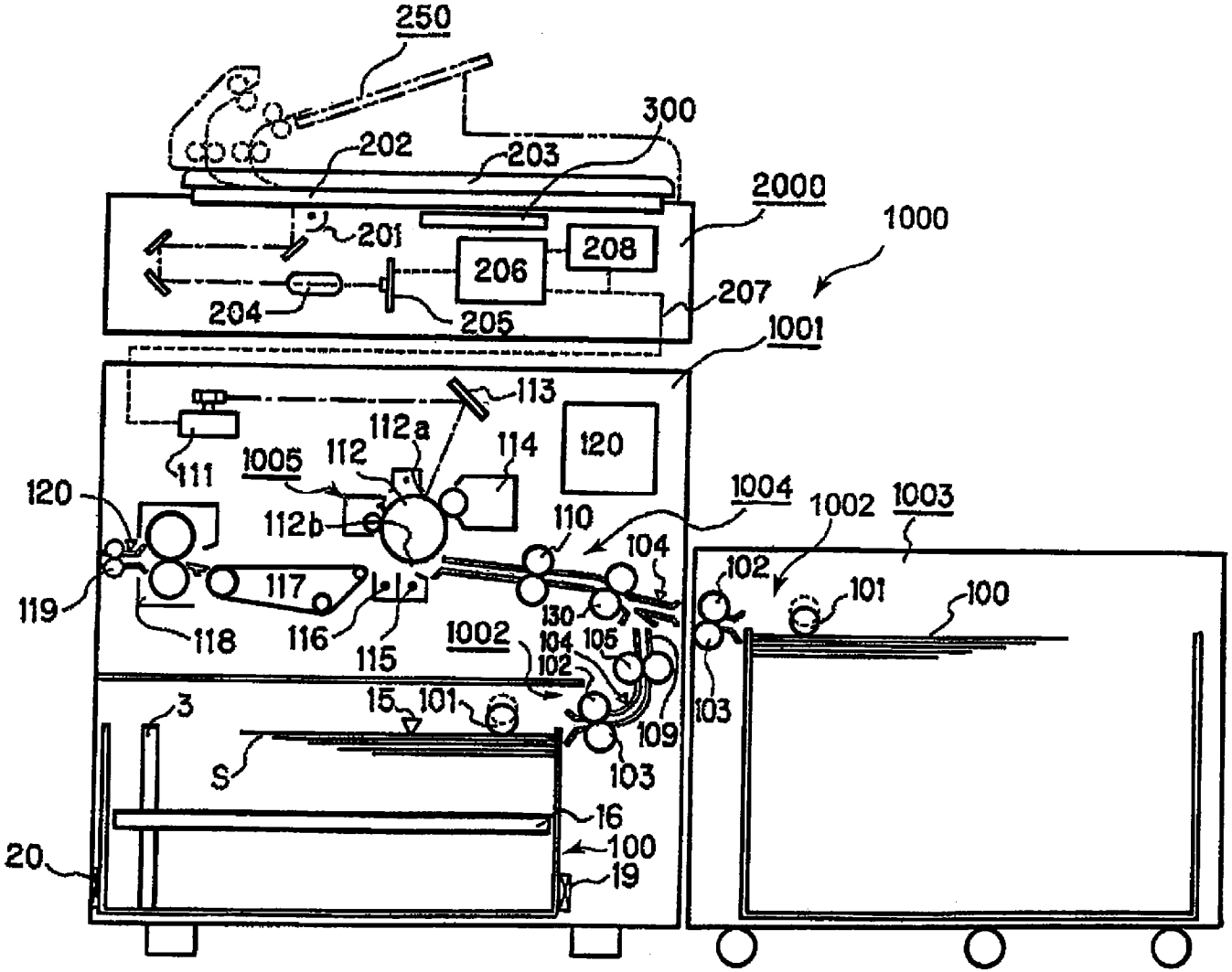
FIG. 1 is a sectional view illustrating a printer which is of an example of an image forming apparatus including a sheet feeder apparatus according to a first embodiment of the invention.

FIG. 1 is a sectional view illustrating a printer which is of an example of an image forming apparatus including a sheet feeder apparatus according to a first embodiment of the invention.

Referring to FIG. 1, a printer 1000 includes a printer body 1001 and a scanner 2000. The scanner 2000 is disposed in an upper surface of the printer body 1001 to scan an original.

The scanner 2000 includes a scanning optical system light source 201, a platen glass 202, an opening and closing original pressing plate 203, a lens 204, a light acceptance element (photo-electric conversion element) 205, an image processing portion 206, and a memory portion 208 in which an image processing signal processed by the image processing portion 206 is stored.

The original (not shown) placed on the platen glass 202 is scanned by irradiating the original with light emitted from the scanning optical system light source 201. The scanned original image is electrically coded and converted into an electric signal 207 after processed by the image processing portion 206, and the image information is transmitted to a laser scanner 111 which is of an image forming unit. Alternatively, the image information processed by the image processing portion 206 and coded may be temporarily stored in the memory portion 208 and transmitted to the laser scanner 111 by a signal from a controller 120 if needed.

The printer body 1001 includes an image forming portion 1005, a sheet feeder apparatus 1002 which feeds a sheet S, and a sheet conveying apparatus 1004 which conveys the sheet S fed by the sheet feeder apparatus 1002 to the image forming portion 1005. The printer body 1001 also includes a controller 120 which is of a control unit for controlling the printer 1000.

A large-capacity paper deck 1003 is an optional sheet feeder apparatus which is detachably attached to the printer 1000. The paper deck 1003 also includes the sheet feeder apparatus 1002 which conveys the sheet S to the image forming portion 1005.

The sheet feeder apparatus 1002 on the printer body side includes a separation portion, and the separation portion includes a sheet storage portion 100 which is provided in the printer body 1001 so as to be able to be drawn, a pickup roller 101, a feed roller 102, and a retard roller 103. The sheet feeder apparatus 1002 on the paper deck also includes the separation portion, and the separation portion includes the pickup roller 101, the feed roller 102, and the retard roller 103.

The sheets S in the sheet storage portion 100 are separated and fed one by one using the pickup roller 101 which is elevated and rotated at predetermined timing. A sheet feed sensor 104 is provided in the neighborhood on a downstream side of the feed roller 102 and the retard roller 103 in a sheet conveying direction, and the sheet feed sensor 104 can detect passage of the sheet S.

The sheet conveying apparatus 1004 includes a registration roller portion, and the registration roller portion includes a conveying roller pair 105, a pre-registration roller pair 130, and a registration roller pair 110. The conveying roller pair 105 causes the sheet S fed from the sheet feeder apparatus 1002 to abut once on the suspended registration roller pair 110.

The once abutment of the sheet S on the suspended registration roller pair 110 corrects the skew feeding generated in the sheet S in feeding and conveying the sheet S, and the sheet S is conveyed to the image forming portion 1005 by rotation of the registration roller pair 110.

The image forming portion 1005 includes a photosensitive drum 112, a laser scanner 111, a development device 114, a transfer charger 115, and a separating charger 116. In forming the image, a laser beam from the laser scanner 111 is folded by a mirror 113, an exposure position 112*a* on the photosensitive drum 112 rotated clockwise is irradiated with the laser beam to form a latent image on the photosensitive drum 112. Then, the latent image formed on the photosensitive drum 112 is visualized in the form of a toner image by the development device 114.

The position irradiated with the laser beam can be changed by a control signal from the controller 120 through a laser writing position control circuit, so that latent image forming position in a longitudinal direction, i.e., in a so-called main scanning direction can be changed on the photosensitive drum 112.

The transfer charger 115 transfers the toner image on the photosensitive drum 112 to the sheet S at a transfer portion 112*b*. The separating charger 116 electrostatically separates the sheet S to which the toner image is transferred from the photosensitive drum 112, a conveying belt 117 conveys the sheet S to a fixing device 118 to fix the toner image, and a discharge roller 119 discharges the sheet S. A sheet discharge sensor 121 is provided in a conveying path between the fixing device 118 and the discharge roller 119 to be able to detect the passage of the sheet S.

In the first embodiment, the printer body 1001 and the scanner 2000 are separately formed. Alternatively, the printer body 1001 and the scanner 2000 may integrally be formed. Even if the printer body 1001 and the scanner 2000 are separately formed, the printer body 1001 acts as the copying machine when a processing signal of the scanner 2000 is inputted to the laser scanner 111, the printer body 1001 acts as the facsimile when a transmission signal of the facsimile is inputted to the laser scanner 111, and the printer body 1001 acts as the printer when an output signal of a personal computer is inputted to the laser scanner 111.

On the contrary, the printer body 1001 acts as the facsimile when the processing signal of the image processing portion 206 of the scanner 2000 is transmitted to another facsimile. In the scanner 2000, when an automatic original feeding apparatus 250 shown by an alternate long and two short dashes line is attached instead of the original pressing plate 203, the original can automatically be scanned.

The sheet storage portion 100 of the sheet feeder apparatus 1002 will be described below.

Figure 2:
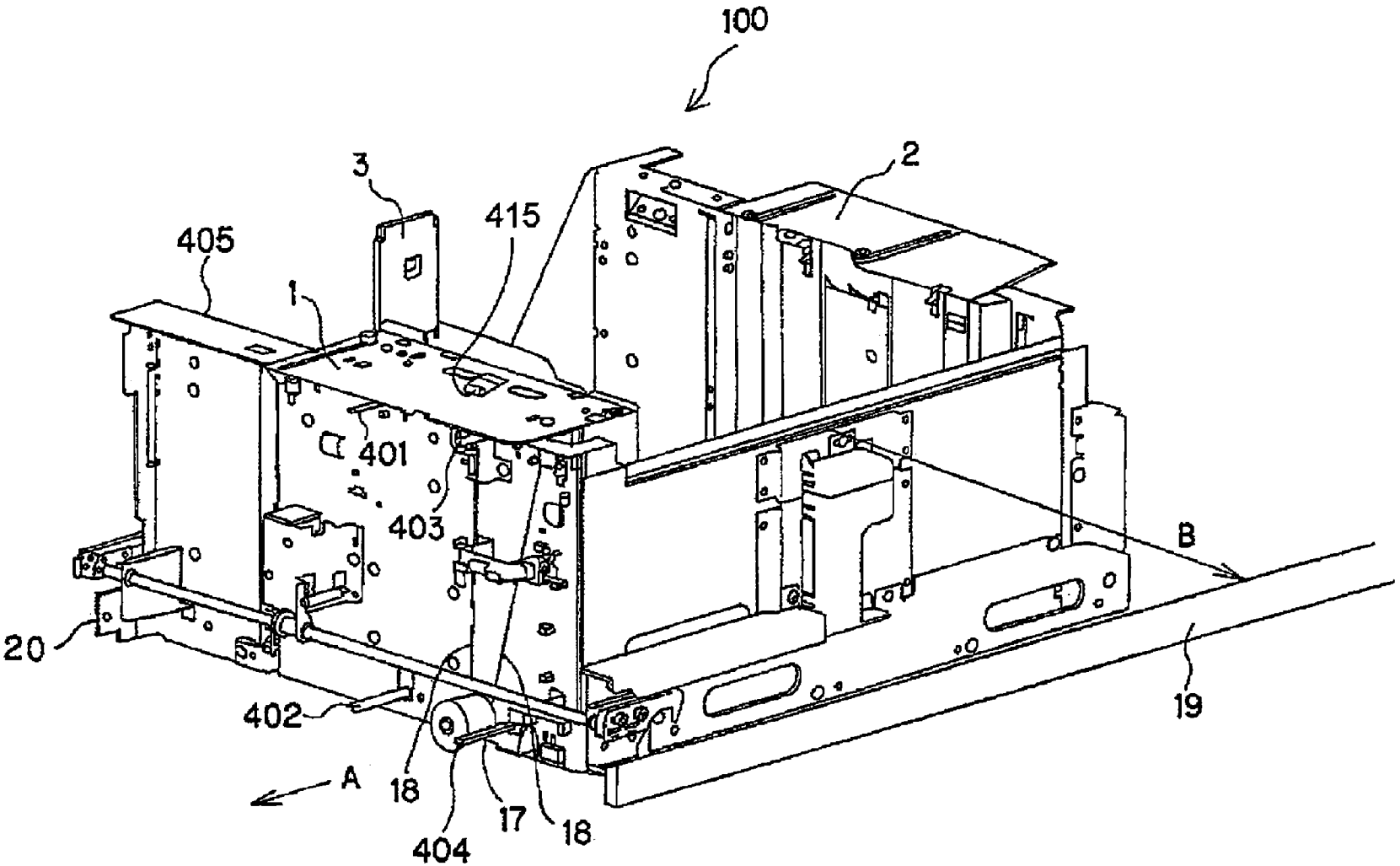
FIG. 2 is a perspective view illustrating a sheet storage portion provided in a printer body.

FIG. 2 is a perspective view illustrating the sheet storage portion 100. The sheet storage portion 100 can be drawn from the printer body 1001 along rails 19 and 20 in a direction (width direction) shown by an arrow A orthogonal to the sheet feeding direction shown by an arrow B. In the case where an operator sets the sheets S, the operator can draw the sheet storage portion 100 to the front side (direction of the arrow A) from the printer body 1001.

A detachment detection sensor (not shown) is provided in the sheet storage portion 100, and the detachment detection sensor can detect whether the sheet storage portion 100 is attached to or drawn from the printer body 1001.

A lifter stand 16 shown in FIG. 1 is provided in the sheet storage portion 100 to stack the sheets thereon, and the lifter stand 16 is suspended by a wire 18 wound around a pulley 17 rotated by a lifter motor (not shown). The lifter stand 16 is lifted and lowered by normally and reversely rotating the lifter motor.

When the detachment detection sensor detects that the sheet storage portion 100 is drawn from the printer body 1001 to set the sheets, the controller 120 controls the lifter motor to lower the lifter stand 16 to a lower limit position. When the detachment detection sensor detects that the sheet storage portion 100 is attached to the printer body 1001, the controller 120 controls the lifter motor to lift the lifter stand 16.

As shown in FIG. 1, a sheet level detection sensor 15 is provided above the sheet storage portion 100 to detect a position of an upper surface of the stacked sheets, and the controller 120 controls the lifter motor using a signal of the sheet level detection sensor 15. That is, the controller 120 controls the lifter motor such that the lifter stand 16 is lifted when the sheet storage portion 100 is attached, and the controller 120 stops the lifter motor when the sheet level detection sensor 15 detects a proper sheet level. Therefore, the sheets stacked on the lifter stand 16 can be maintained at a proper level.

When the sheets S are sequentially fed from the top according to the sheet feeding operation, the sheet level is gradually lowered. When the sheet level detection sensor 15 is turned off, the controller 120 controls the lifter motor again such that the lifter stand 16 is lifted to maintain the sheet level within a predetermined range.

A front-portion side regulating plate 1 and a rear-portion side regulating plate 2 are provided in the sheet storage portion 100 while facing each other. The front-portion side regulating plate 1 and the rear-portion side regulating plate 2 are of the regulating member which regulates a position in a depth direction of the sheet S, i.e., the position of the sheet in the width direction. The front-portion and rear-portion side regulating plates 1 and 2 can be moved in the width direction within the sheet storage portion 100 according to the size of the sheet S in the depth direction (width direction).

A rear-end regulating plate 3 is provided in the sheet storage portion 100 to regulate a rear end position of the sheet S in the sheet feeding direction shown by the arrow B. Similarly to the front-portion and rear-portion side regulating plates 1 and 2, the rear-end regulating plate 3 can be moved in the sheet feeding direction within the sheet storage portion 100 according to the size of the sheet S in a length direction.

In FIG. 2, the front-portion side regulating plate 1 is provided so as to be movable with respect to a fixed wall 405.

Figure 3:
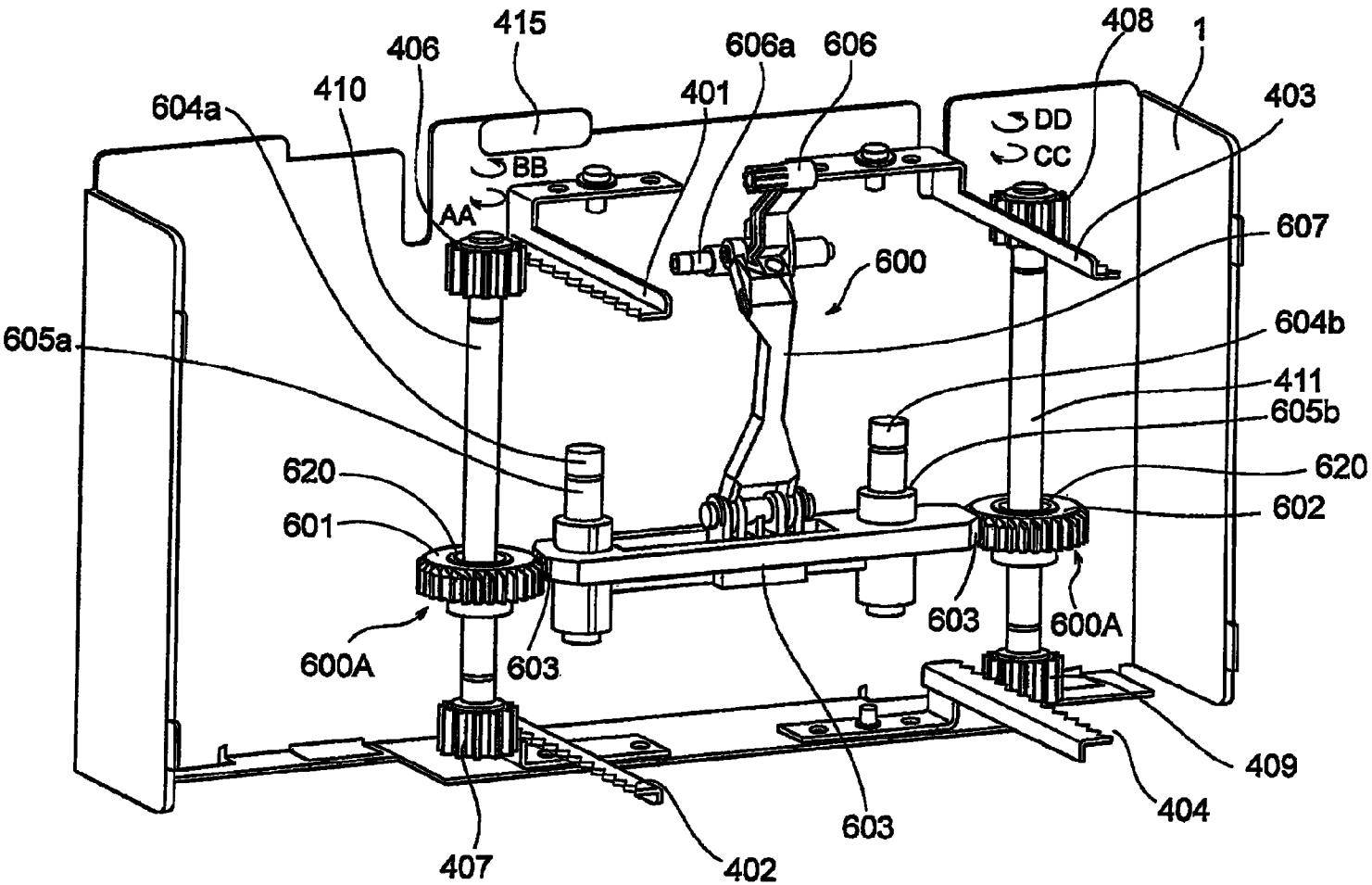
FIG. 3 is a view explaining a configuration of a front-portion side regulating plate provided in the sheet storage portion.

As shown in FIG. 3, four (plural) rack gears 401 to 404 are vertically provided on the outer surface side (on the side of the surface opposite the surface abutting on the sheet) of the front-portion side regulating plate 1, and the rack gears 401 to 404 are extended in a moving direction of the front-portion side regulating plate 1 to retain the front-portion side regulating plate 1 near both sides of the front-portion side regulating plate 1. Even if the sheet S has a large width, the front-portion side regulating plate 1 can regulate the sheet end with the sheet end regulating surface inclined relative to the sheet conveying direction by providing the four rack gears 401 to 404 near both sides of the front-portion side regulating plate 1.

In the four rack gears 401 to 404, the first and second rack gears 401 and 402 are disposed at the same position in a right and left direction (sheet feeding direction) and at different positions in the vertical direction. Similarly the third and fourth rack gears 403 and 404 are disposed at the same position in the right and left direction (sheet feeding direction) and at different positions in the vertical direction. The first and third rack gears 401 and 403 are disposed at the substantially same level, and the second and fourth rack gears 402 and 404 are disposed at the substantially same level.

The first to fourth rack gears 401 to 404 engage first to fourth pinion gears 406 to 409 which are of relay gears provided in a fixed wall 405 of the sheet storage portion 100. The first to fourth pinion gears 406 to 409 engaging the first to fourth rack gears 401 to 404 are also rotated when the front-portion side regulating plate 1 is moved in the width direction.

The first pinion gear 406 and the second pinion gear 407 are coaxially provided in upper and lower portions of a first rotating shaft 410. The second pinion gear 407 is rotated when the first pinion gear 406 is rotated, while the first pinion gear 406 is rotated when the second pinion gear 407 is rotated.

On the other hand, the third pinion gear 408 and the fourth pinion gear 409 are coaxially provided in upper and lower portions of a second rotating shaft 411. The fourth pinion gear 409 is rotated when the third pinion gear 408 is rotated.

A first one-way gear 601 is provided in the first rotating shaft 410, and the first one-way gear 601 is a lock gear in which a one-way clutch 620 is provided in an inner circumference. When the first rotating shaft 410 is rotated in a direction of an arrow AA by action of the one-way clutch 620, the first one-way gear 601 is locked by the first rotating shaft 410, and the first one-way gear 601 is rotated while being integral with the first rotating shaft 410. The first one-way gear 601 is idled when the first rotating shaft 410 is rotated in a direction of an arrow BB.

A second one-way gear 602 is provided in the second rotating shaft 411, and the second one-way gear 602 is the lock gear in which the one-way clutch 620 is provided in the inner circumference. When the second rotating shaft 411 is rotated in a direction of an arrow DD by action of the one-way clutch 620, the second one-way gear 602 is locked by the second rotating shaft 411, and the second one-way gear 602 is rotated while being integral with the second rotating shaft 411. The second one-way gear 602 is idled when the second rotating shaft 411 is rotated in a direction of an arrow CC.

Referring to FIG. 3, a stopper rack 603 is a lock member which engages the first and second one-way gears 601 and 602 to lock the first and second one-way gears 601 and 602. Rack portions 603*a* and 603*b* are formed in end portions of the stopper rack 603, and the rack portions 603*a* and 603*b* are of gear portion which engage the first and second one-way gears 601 and 602.

Guide portions 605*a* and 605*b* are provided in the stopper rack 603, and moving shafts 604*a* and 604*b* vertically provided in the fixed wall 405 are inserted into the guide portions 605*a* and 605*b*. The stopper rack 603 is slid through the guide portions 605*a* and 605*b* along the moving shafts 604*a* and 604*b* provided in the fixed wall 405, which allows the stopper rack 603 to be moved in the vertical direction (axial directions of the moving shafts 604*a* and 604*b*).

A side guide stopper knob 606 is vertically turned about a turning shaft 606*a* horizontally provided in the fixed wall 405, and a link 607 couples the side guide stopper knob 606 and the stopper rack 603. The side guide stopper knob 606 is vertically turned, whereby the stopper rack 603 is vertically moved (lifted and lowered) through the link 607.

In FIG. 3, a fixing portion 600 fixes the front-portion side regulating plate 1 (and rear-portion side regulating plate 2) to a position according to the sheet size. The fixing portion 600 includes first to the fourth rack gears 401 to 404, the first to fourth pinion gears 406 to 409, the first and second rotating shafts 410 and 411, and lock mechanisms 600A.

The lock mechanism 600A includes the first and second one-way gears 601 and 602, the one-way clutches 620, and the stopper rack 603. The one-way clutches 620 restrict relative rotations between the first and second rotating shafts 410 and 411 and the first and second one-way gears 601 and 602 respectively. The lock mechanism 600A regulates the rotations of the first and second rotating shafts 410 and 411 when the front-portion side regulating plate 1 is moved away from the regulated sheets. The lock mechanism 600A permits the rotations of the first and second rotating shafts 410 and 411 when the front-portion side regulating plate 1 is moved in the direction in which the front-portion side regulating plate 1 contacts the regulated sheets.

Figure 4:
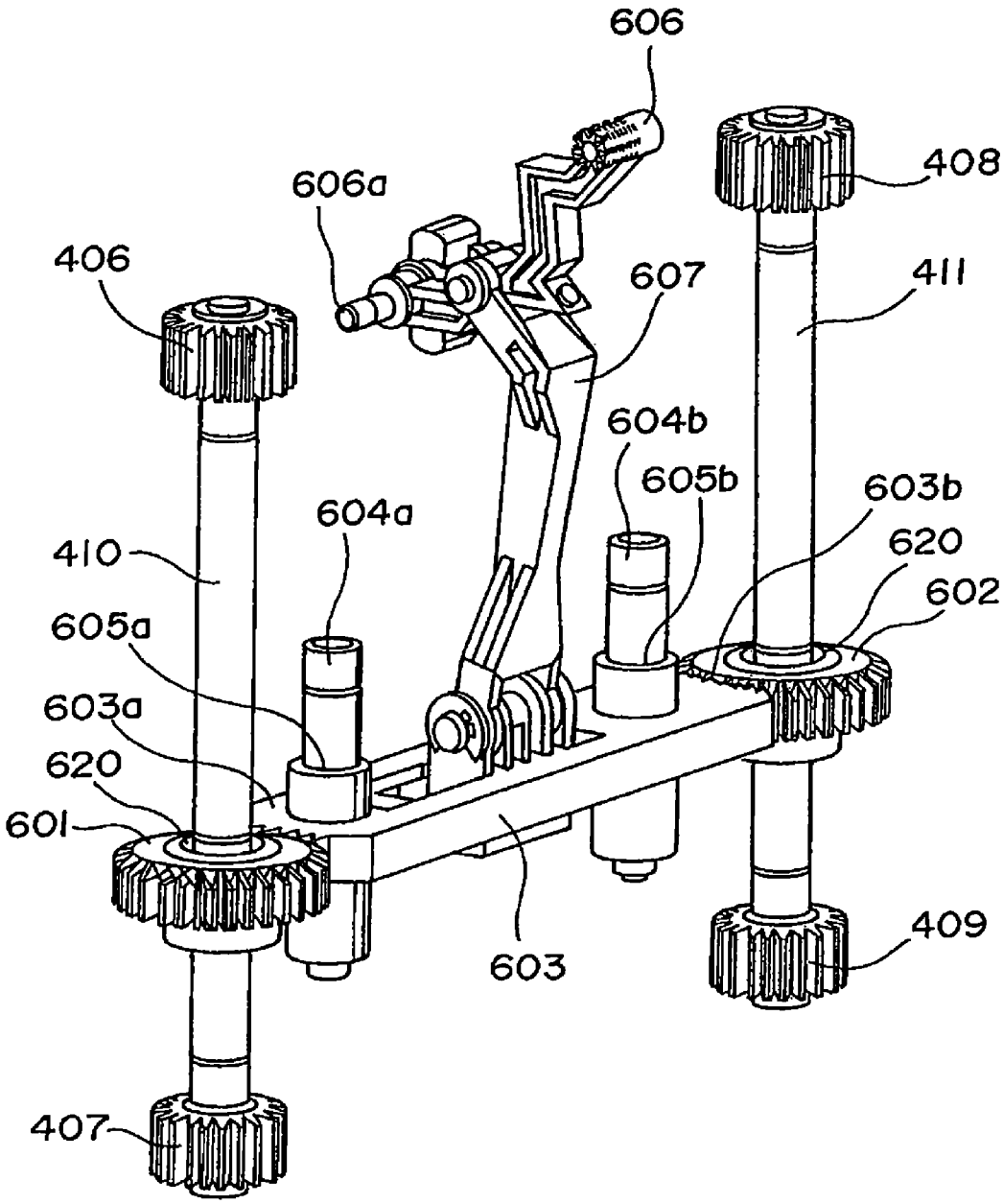
FIG. 4 illustrates a locked state of a fixing portion fixing the front-portion side regulating plate provided in the sheet storage portion.
Figure 5:
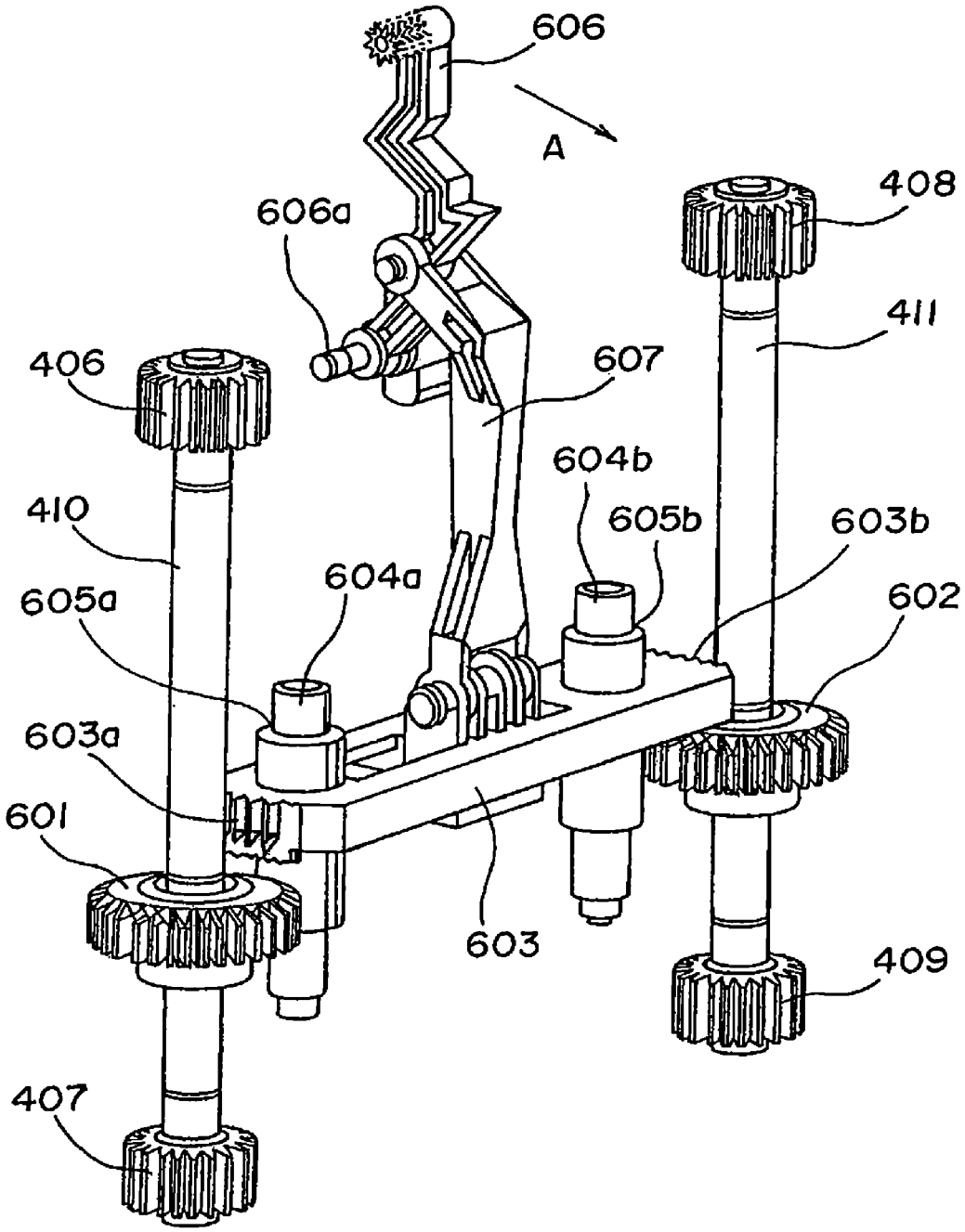
FIG. 5 illustrates an unlocked state of the fixing portion.

When the side guide stopper knob 606 is turned downward, the stopper rack 603 is lowered, and the first and second one-way gears 601 and 602 and the rack portions 603*a* and 603*b* engage each other as shown in FIG. 4 respectively. When the side guide stopper knob 606 is turned upward, the first and second one-way gears 601 and 602 and the rack portions 603*a* and 603*b* disengage each other as shown in FIG. 5 respectively.

In the first embodiment, the side guide stopper knob 606 is disposed such that rotation direction to be fixed becomes identical to the drawing direction A of the sheet storage portion 100 shown in FIG. 2. An abutment portion (not shown) is provided in the printer body 1001, and the abutment portion abuts on the side guide stopper knob 606 when the sheet storage portion 100 is attached while the side guide stopper knob 606 is turned upward.

Therefore, when the sheet storage portion 100 is attached to the printer body 1001 while the side guide stopper knob 606 is turned upward, the side guide stopper knob 606 strikes the abutment portion (not shown) on the printer body side, and the side guide stopper knob 606 is automatically turned downward. As a result, the front-portion side regulating plate 1 is always locked in attaching the sheet storage portion 100.

Figure 6:
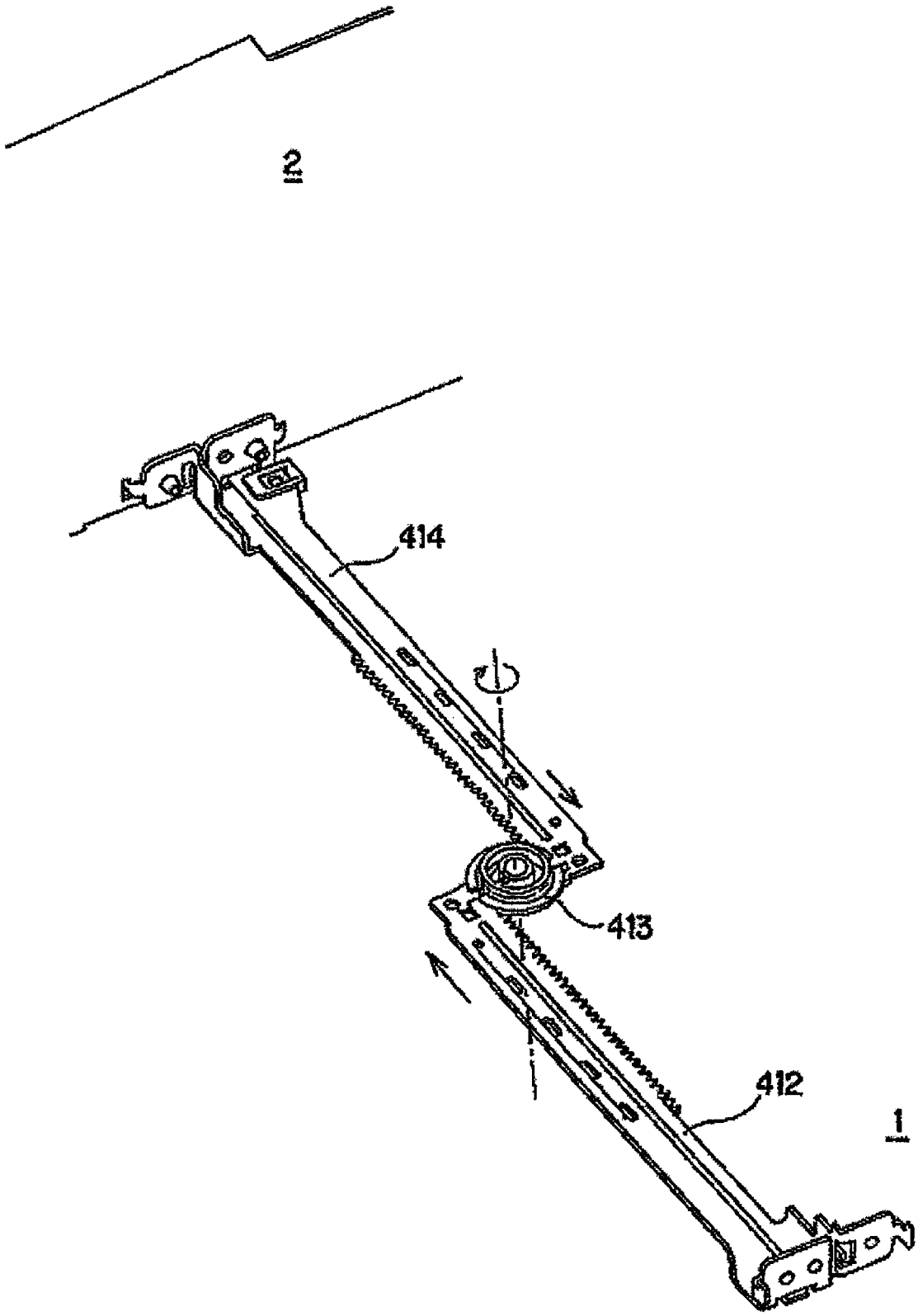
FIG. 6 is a perspective view illustrating a rack gear and a pinion gear which interlock the front-portion side regulating plate and rear-portion side regulating plate provided in the sheet storage portion.

As shown in FIG. 6, a rack gear 412 for interlocking the rear-portion side regulating plate 2 is provided at a lower end on the inner surface side of the front-portion side regulating plate 1 (surface side facing the rear-portion side regulating plate 2). The rack gear 412 engages a pinion gear 413 provided in the substantially central portion in a bottom of the sheet storage portion. In FIG. 6, an interlocking rack gear 414 is provided at a lower end on the inner surface side of the rear-portion side regulating plate 2 (surface side facing the front-portion side regulating plate 1). The rack gear 414 also engages the pinion gear 413.

Thus, the rack gear 412 of the front-portion side regulating plate 1 and the rack gear 414 of the rear-portion side regulating plate 2 can engage a pinion gear 413 to interlock the front-portion side regulating plate 1 and the rear-portion side regulating plate 2.

Operations of the front-portion and rear-portion side regulating plates 1 and 2 in storing the sheets having the larger sizes in the sheet storage portion 100 will be described below.

The operator lifts the side guide stopper knob 606 to perform the disengagement between the first and second one-way gears 601 and 602 and the rack portions 603*a* and 603*b* of the stopper rack 603 as shown in FIG. 5 respectively. Then, an interval in the width direction between the front-portion and rear-portion side regulating plates 1 and 2 is set larger than the sheet width.

As shown in FIG. 3, an upper grip portion 415 is provided in the upper end portion of the front-portion side regulating plate 1, and the operator holds the upper grip portion 415 to move the front-portion side regulating plate 1 in the direction in which a distance with the rear-portion side regulating plate 2 is widened (direction in which the front-portion side regulating plate 1 is moved away from the sheet). At this point, the first and third rack gears 401 and 403 are moved with respect to the first and third pinion gears 406 and 408 located in the upper portions, thereby rotating the first and third pinion gears 406 and 408 in the directions of the arrows AA and DD respectively.

When the first and third pinion gears 406 and 408 are rotated in the directions of the arrows AA and DD respectively, the torques of the first and third pinion gears 406 and 408 are transmitted through the first and second rotating shafts 410 and 411, and therefore the second and fourth pinion gears 407 and 409 located in the lower portions are rotated to move the second and fourth rack gears 402 and 404 located in the lower portions. At this point, the first and second one-way gears 601 and 602 are freely rotated according to the movements of the first and second rotating shafts 410 and 411.

The rack gear 412 shown in FIG. 6 is moved to rotate the pinion gear 413 according to the movement of the front-portion side regulating plate 1, and the rack gear 414 fixed to the rear-portion side regulating plate 2 is moved. Therefore, similarly the rear-portion side regulating plate 2 is moved outward.

Then, the operator sets the sheets, and the operator holds the upper grip portion 415 to inwardly move the front-portion side regulating plate 1 such that the front-portion side regulating plate 1 is fit to the sheet size. The movement of the upper portion moves the first and third rack gears 401 and 403 with respect to the first and third pinion gears 406 and 408 to rotate the first and third pinion gears 406 and 408 in the directions of the arrows BB and CC.

The rotations of the first and third pinion gears 406 and 408 in the directions of the arrows BB and CC rotate the second and fourth pinion gears 407 and 409 to move the second and fourth rack gears 402 and 404 located in the lower portions. At this point, the first and second one-way gears 601 and 602 are freely rotated according to the movements of the first and second rotating shafts 410 and 411. Similarly the rear-portion side regulating plate 2 is moved inward according to the movement of the front-portion side regulating plate 1.

After the front-portion side regulating plate 1 and the rear-portion side regulating plate 2 are moved to the positions corresponding to the sheet size, the side guide stopper knob 606 is turned downward such that the positions of the front-portion side regulating plate 1 and the rear-portion side regulating plate 2 are fixed.

Therefore, as shown in FIG. 4, the stopper rack 603 is lowered and the rack portions 603*a* and 603*b* formed at both the ends of the stopper rack 603 engage the first and second one-way gears 601 and 602 respectively. Because the stopper rack 603 is not moved in the width direction by the moving shafts 604*a* and 604*b*, the rotations of the first and second one-way gears 601 and 602 are regulated when the rack portions 603*a* and 603*b* engage the first and second one-way gears 601 and 602. That is, the first and second one-way gears 601 and 602 are locked.

When the first one-way gear 601 is locked, the rotation of the first rotating shaft 410 is regulated in the AA direction by the action of the one-way clutch 620. The rotation in the AA direction is the rotation in the direction in which the front-portion side regulating plate 1 is moved away from the sheets. When the second one-way gear 602 is locked, the rotation of the second rotating shaft 411 is regulated in the DD direction. The rotation in the DD direction is the rotation in the direction in which the front-portion side regulating plate 1 is moved away from the sheets.

That is, when the rack portions 603*a* and 603*b* formed at both the ends of the stopper rack 603 engage the first and second one-way gears 601 and 602, the rotations of the first and second rotating shafts 410 and 411 are regulated in the direction in which the front-portion side regulating plate 1 is moved away from the sheets. This enables the slip of the front-portion side regulating plate 1 to be prevented in the direction in which the distance with the rear-portion side regulating plate 2 is enlarged.

In the first embodiment, the rack portion 603*a* and 603*b* of the stopper rack 603 engage the first and second one-way gears 601 and 602 from above by the downward turning operation of the side guide stopper knob 606.

Figure 7:
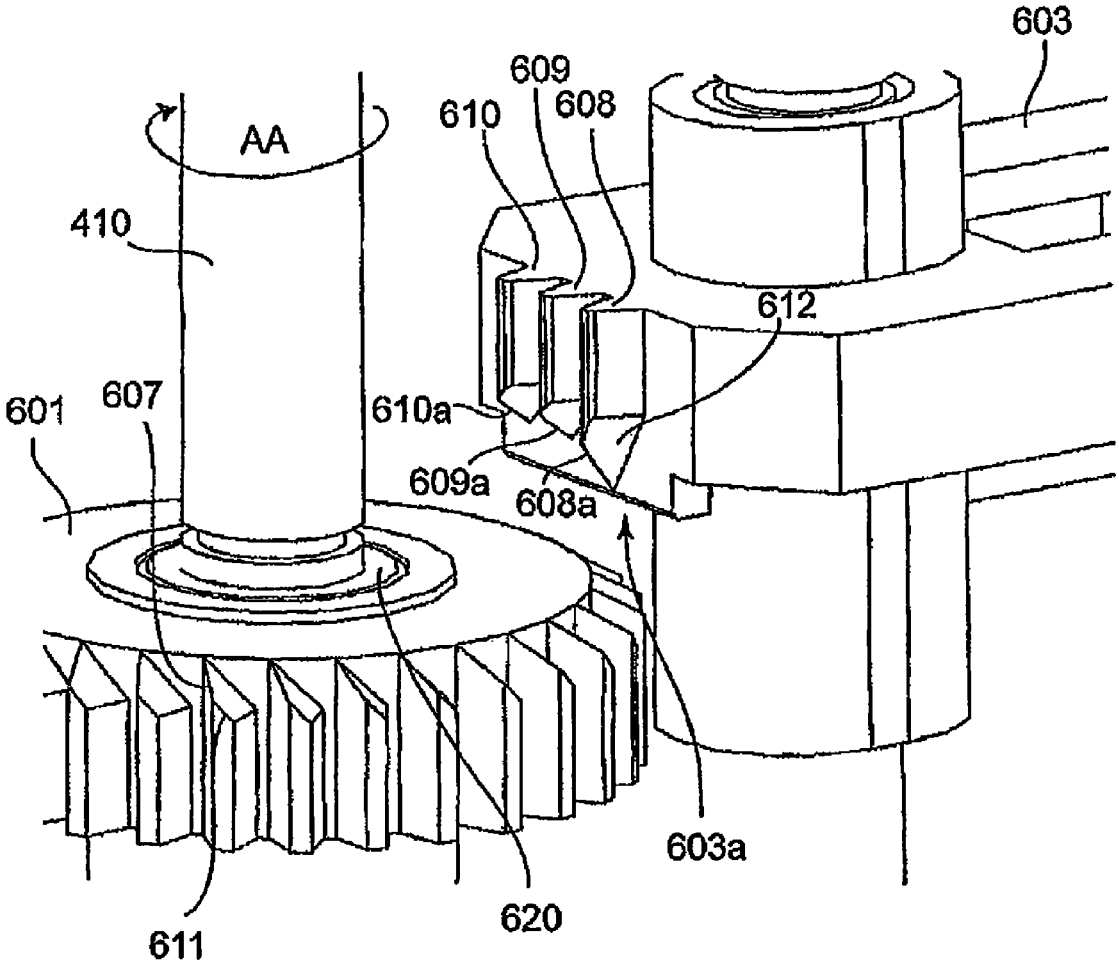
FIG. 7 is a perspective view illustrating a configuration of a first one-way gear and a rack portion of a stopper rack which constitute the fixing portion fixing the front-portion side regulating plate.
Figure 8:
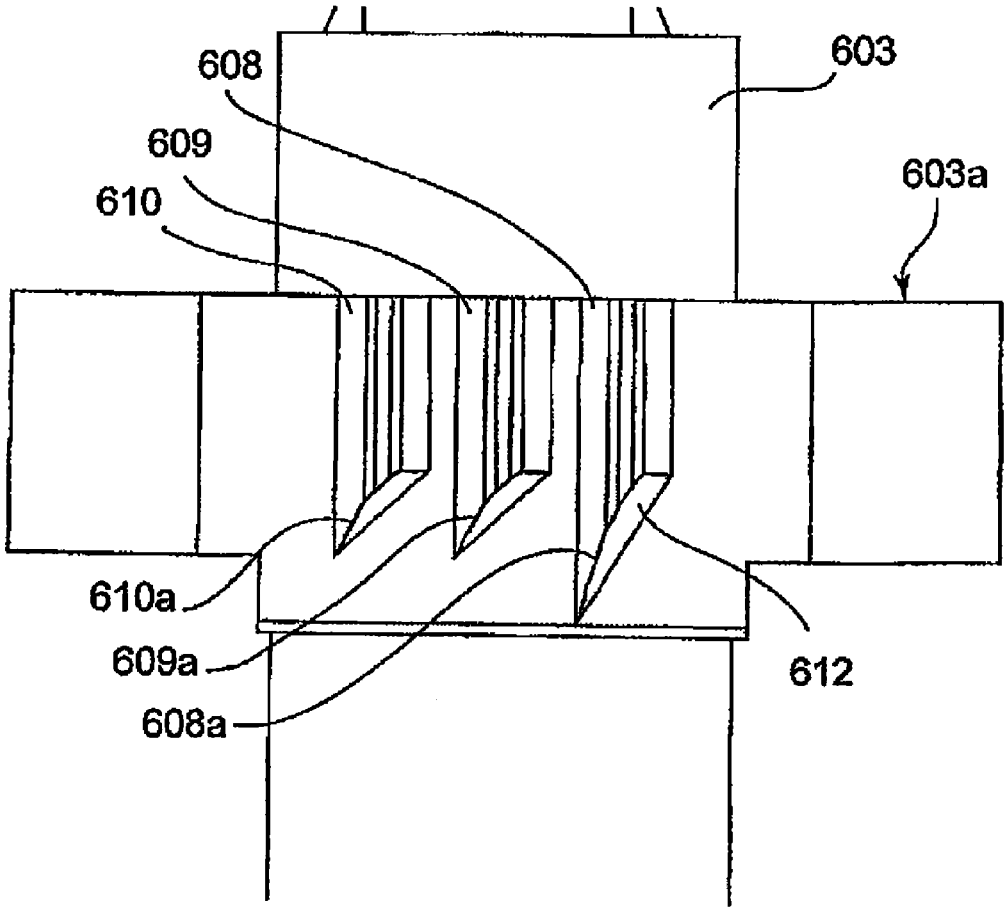
FIG. 8 is a side view illustrating the rack portion of the stopper rack.

FIG. 7 illustrates a configuration of the first one-way gear 601 and the rack portion 603*a* of the stopper rack 603. The second one-way gear 602 and the rack portion 603*b* of the stopper rack 603 have the same configurations.

In the case where the rack portion 603a engages the first one-way gear 601 from above, when side faces of tooth surfaces of the first one-way gear 601 and rack portion 603*a* are formed in flat shapes, the rack portion 603*a* does not engage the first one-way gear 601 as long as phases of the first one-way gear 601 and rack portion 603*a* are just matched with each other.

Therefore, when the rack is inserted in the gear, usually chevron inclinations whose tops are located in center lines of the cogs are provided in the first one-way gear 601 and rack portion 603*a*. However, depending on the phase during the engagement, sometimes the first one-way gear 601 can engage the rack portion 603*a* when the one-way gear 601 is rotated in the AA direction, or sometimes the first one-way gear 601 can engage the rack portion 603*a* when the one-way gear 601 is rotated in the BB direction.

At this point, although only the first one-way gear 601 is rotated in the AA direction by the action of the one-way clutch 620, the first one-way gear 601 is rotated in the BB direction while being integral with the first rotating shaft 410 due to the action of the one-way clutch 620.

In this case, the first and second pinion gears 406 and 407 engaging the first rotating shaft 410 and the first and second rack gears 401 and 402 are moved, and the front-portion side regulating plate 1 is moved onto the sheet side, whereby the first one-way gear 601 can be rotated. A large force is required to move the first rotating shaft 410, the first and second pinion gears 406 and 407, the first and second rack gears 401 and 402, and the front-portion side regulating plate 1.

However, the force cannot be generated by the side guide stopper knob 606. When the chevron inclinations whose tops are located in center lines of the cogs are provided in the first one-way gear 601 and rack portion 603*a*, sometimes the first one-way gear 601 and the rack portion 603*a* cannot engage each other depending on the phases of the first one-way gear 601 and rack portion 603*a*.

In the first embodiment, the first and second one-way gears 601 and 602 are always rotated in the directions AA and DD when engaging the rack portions 603*a* and 603*b* of the stopper rack 603.

Therefore, in the first embodiment, the cog of the first one-way gear 601 is inclined so as to become higher toward the AA direction in which the one-way clutch 620 regulates the rotation of the first rotating shaft 410, and the cog of the first one-way gear 601 is inclined such that an edge line 607 becomes highest in the tooth surface in the circumferential direction.

An inclined surface 611 is provided in the AA direction on the rack portion side (lock member side) of the cog of the first one-way gear 601 such that the downstream side in the AA direction becomes higher, i.e., such that the inclined surface 611 is inclined while orientated toward the rack portion side. As used herein, the term "high" and "low" shall mean that the gravitational direction is a bottom (low) and the opposite direction is top (high).

Vertically-extended three (plural) cogs are provided in the rack portion 603*a* to ensure a fixing force. In the three cogs, a central cog 609 is referred to as second cog, a cog 608 located on the downstream side in the AA direction of the second cog 609 is referred to as first cog, and a cog 610 located on the upstream side in the AA direction of the second cog 609 is referred to as third cog.

The first to third cogs 608, 609, and 610 are formed such that edge lines 608*a*, 609*a*, and 610*a* become lowest in the circumferential direction about the first rotating shaft 410. That is, inclined surfaces 612 are provided on the first one-way gear sides (lock gear sides) of the first to third cogs 608, 609, and 610. The inclined surface 612 is provided such that the downstream side in the AA direction becomes higher.

Figure 9:
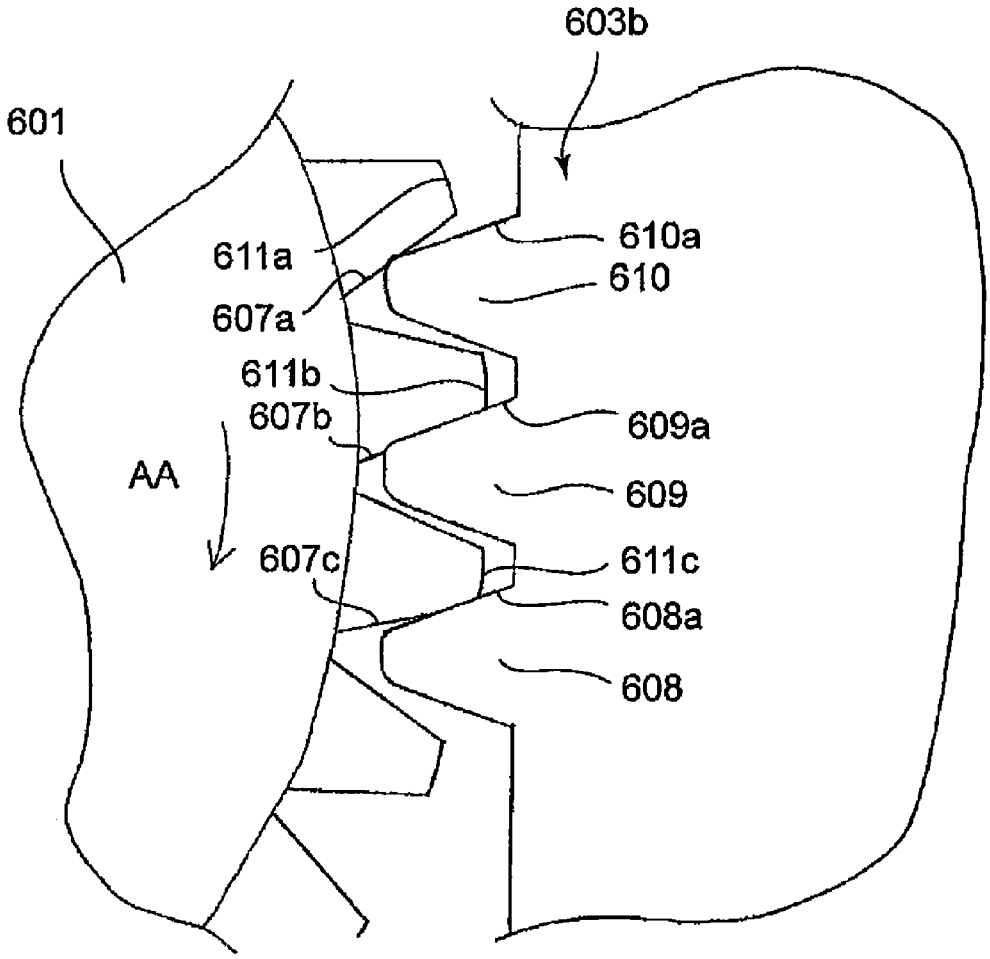
FIG. 9 is a top view illustrating the first one-way gear and the rack portion of the stopper rack.

FIG. 9 is a top view illustrating the first one-way gear 601 and the rack portion 603*a*. FIG. 9 illustrates the state in which the cogs of the first one-way gear 601 abut on the cogs of the rack portion 603*a* while the phases are shifted from each other. In FIG. 9, the edge line 608*a*, 609*a*, and 610*a* illustrate not the surface viewed from above but the inclined surface. When the phases are shifted from each other, the second cog 609 in which the largest force acts on the first one-way gear 601 rotates the one-way gear 601 in the AA direction. However, when the inclination of the edge line 610*a* of the third cog 610 is larger than the inclination of the edge line 607*a* of the first one-way gear 601, sometimes the rotation of the one-way gear 601 in the AA direction is obstructed by the base side (lower end side) of the edge line 610*a*. Therefore, in the first embodiment, the inclination of the edge line 610*a* of the third cog 610 is formed larger than the inclination of the edge line 607*c*.

Figure 10:
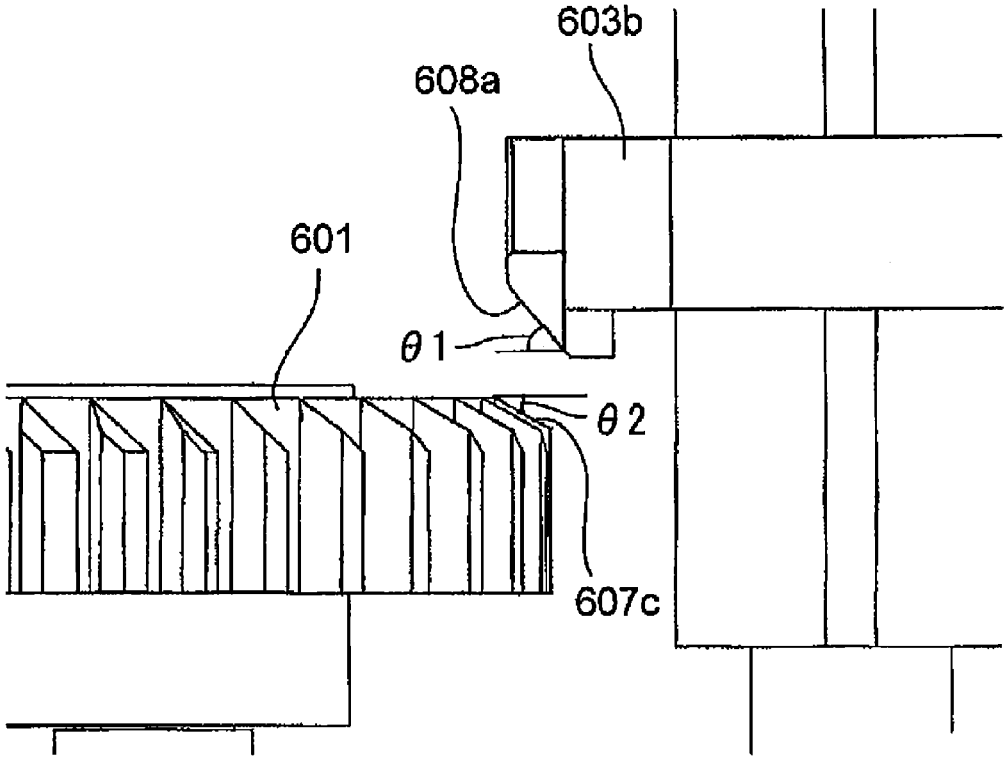
FIG. 10 is a side view illustrating the first one-way gear and the rack portion of the stopper rack.

When the inclination of the edge line 608*a* of the first cog 608 is smaller than the inclination of the edge line 607*c* of the first one-way gear 601, sometimes the rotation of the one-way gear 601 in the AA direction is obstructed by the upper end side of the edge line 608*a*. Therefore, in the first embodiment, the inclination of the edge line 608*a* of the first cog 608 is formed larger than the inclination of the edge line 607*c* as shown in FIG. 10. In FIG. 10, an angle θ1 is formed between the edge line 608*a* on the side closer to the first one-way gear 601 of the first cog 608 of the rack portion 603*a* and a plane perpendicular to the rotation center of the first one-way gear 601, and an angle θ2 is formed between the edge line 607*c* on the side closer to the rack portion in the cog of the first one-way gear 601 and the plane perpendicular to the rotation center of the first one-way gear 601.

That is, in the first embodiment, the angle θ1 formed between the plane perpendicular to the rotation center of the first one-way gear 601 and the edge line 608*a* of the first cog 608 is larger than the angle θ2 formed between the plane perpendicular to the rotation center of the first one-way gear 601 and the edge line 607*c* of the first one-way gear 601.

The first cog 608 is extended onto the first one-way gear side rather than other cogs 609 and 610. That is, the edge line 608*a* of the first cog 608 is located closer to the first one-way gear 601 than the edge lines of the edge line 609*a* and 610*a* of the other cogs 609 and 610.

Therefore, first the edge line 608*a* of the first cog 608 abuts on the edge line 607*c* of the first one-way gear 610 before other cogs 609 and 610 (edge lines 609*a* and 610*a*) abut on the edge line 607*c* of the first one-way gear 610.

Even if the phases of the cogs of the first one-way gear 601 and rack portion 603*a* are shifted from each other, the first one-way gear 601 can be rotated in the AA direction to engage the rack portion 603*a*. Accordingly, the side guide stopper knob 606 is turned downward by the small force, i.e., the force with which only the one-way gear 610 is slightly rotated (up to one cog), which allows the front-portion side regulating plate 1 to substantially be locked without looseness.

Thus, when the rack portion 603*a* engages the first one-way gear 601, the one-way clutch 620 regulates the rotation of the first rotating shaft 410 in the AA direction, so that the front-portion side regulating plate 1 can securely be fixed without generating the lateral slip of the sheet. Even a person with weak power can stably obtain large lock force without losing an operational feeling while the sheet is not laterally slipped. Then, a second embodiment of the invention will be described.

Figure 11:
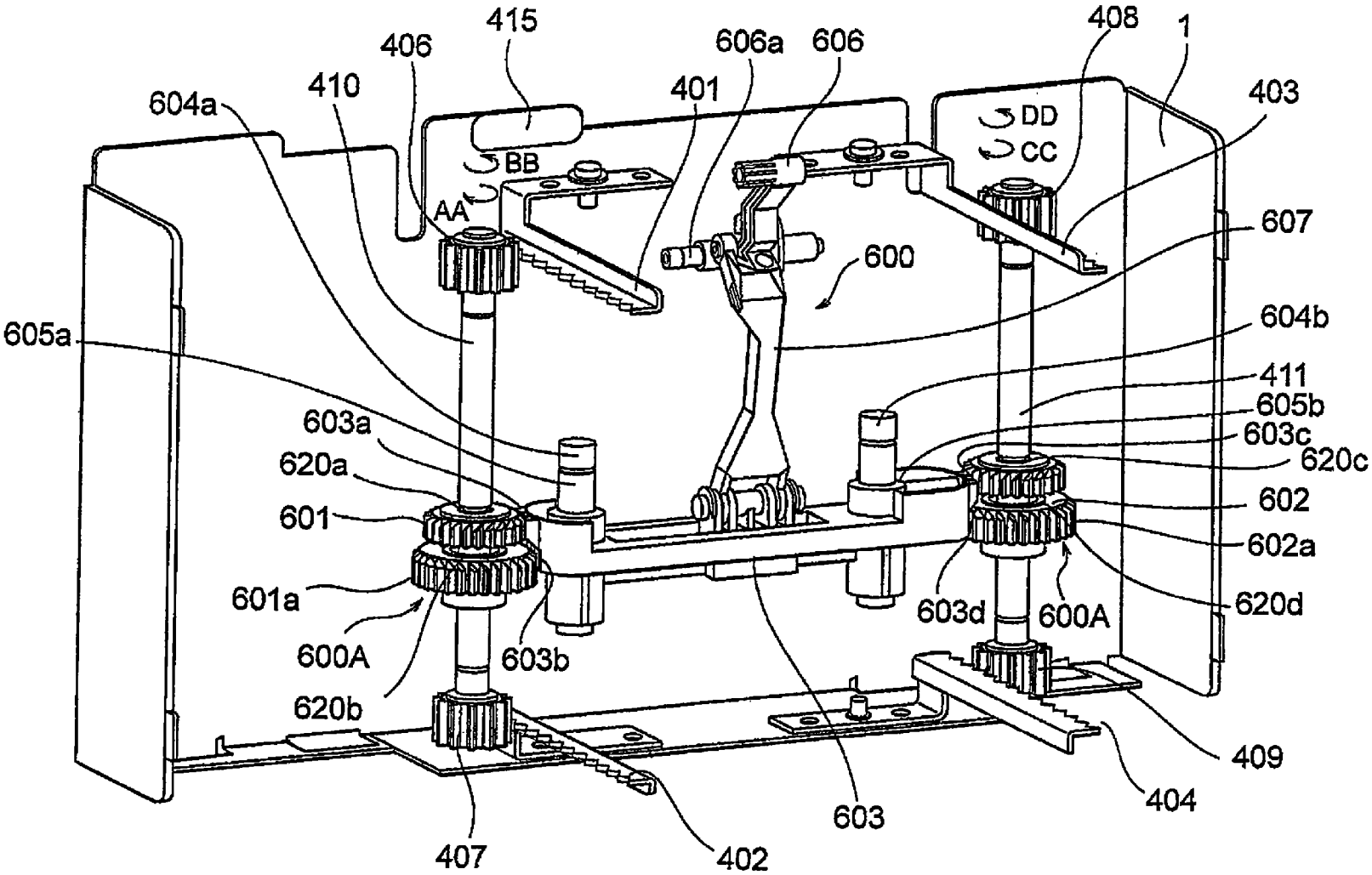
FIG. 11 is a view explaining a configuration of a front-portion side regulating plate provided in a sheet storage portion of a printer according to a second embodiment of the invention.

FIG. 11 is a view explaining a configuration of a front-portion side regulating plate provided in a sheet storage portion of a printer according to a second embodiment of the invention. In FIG. 11, the same numeral as that of FIG. 3 designates the same or corresponding component.

Referring to FIG. 11, the first and third one-way gears 601 and 601*a* are the lock gears provided in the first rotating shaft 410. In the first and third one-way gears 601 and 601*a*, one-way clutches 620*a* and 620*b* having different lock directions are provided in the inner circumferences respectively.

When the first rotating shaft 410 is rotated in the direction of the arrow AA by action of the third one-way clutch 620*b*, the third one-way gear 601*a* is locked by the first rotating shaft 410, and the third one-way gear 601*a* is rotated while being integral with the first rotating shaft 410. The third one-way gear 601*a* is idled when the first rotating shaft 410 is rotated in the BB direction.

The first one-way gear 601 is idled when the first rotating shaft 410 is rotated in the AA direction by action of the first one-way clutch 620*a*, and the first one-way gear 601 is rotated while locked by the first rotating shaft 410 when the first rotating shaft 410 is rotated in the BB direction.

In FIG. 11, the second and fourth one-way gears 602 and 602*a* are the lock gears provided in the second rotating shaft 411. In the second and fourth one-way gears 601 and 601*a*, one-way gears 620*c* and 620*d* having different lock directions are provided in the inner circumferences respectively.

When the second rotating shaft 411 is rotated in the direction of the arrow DD by action of the fourth one-way clutch 620*d*, the fourth one-way gear 602*a* is locked by the second rotating shaft 411, and the fourth one-way gear 602*a* is rotated while being integral with the second rotating shaft 411. The fourth one-way gear 602*a* is idled when the second rotating shaft 411 is rotated in the CC direction.

When the second rotating shaft 411 is rotated in the CC direction by action of the second one-way clutch 620*c*, the second one-way gear 602 is locked by the second rotating shaft 411, and the second one-way gear 602 is rotated while being integral with the second rotating shaft 411. The second one-way gear 602 is idled when the second rotating shaft 411 is rotated in the DD direction.

In FIG. 11, the stopper rack 603 is the lock member which engages the first to fourth one-way gears 601, 601*a*, 602, and 602*a* to lock the first to fourth one-way gears 601, 601*a*, 602, and 602*a*.

Rack portions 603*a* and 603*b* and rack portions 603*c* and 604*d* are formed in both end portions of the stopper rack 603. The rack portions 603*a* and 603*b* are the gear portions engaging the first and third one-way gears 601 and 601*a*, and the rack portions 603*c* and 604*d* are the gear portions engaging the second and fourth one-way gears 602 and 602*a*.

In the second embodiment, the diameter of the third one-way gear 601*a* is larger than that of the first one-way gear 601, and the diameter of the fourth one-way gear 602*a* is larger than that of the second one-way gear 602.

In order to engage the first and third one-way gears 601 and 601*a* having the different diameters, the first rack portion 603*a* is formed while projected toward the side direction in comparison with the second rack portion 603*b*. In order to engage the second and fourth one-way gears 602 and 602*a* having the different diameters, the third rack portion 603*c* is formed while projected toward the side direction in comparison with the fourth rack portion 603*d*.

The guide portions 605*a* and 605*b* are provided in the stopper rack 603, and the moving shafts 604*a* and 604*b* vertically provided in the fixed wall 405 are inserted into the guide portions 605*a* and 605*b*. The stopper rack 603 is slid through the guide portions 605*a* and 605*b* along the moving shafts 604*a* and 604*b* provided in the fixed wall 405, which allows the stopper rack 603 to be moved in the vertical direction (axial directions of the moving shafts 604*a* and 604*b*).

In FIG. 11, the fixing portion 600 fixes the front-portion side regulating plate 1 (and rear-portion side regulating plate 2) to a position according to the sheet size. The fixing portion 600 includes the first to the fourth rack gears 401 to 404, the first to fourth pinion gears 406 to 409, the first and second rotating shafts 410 and 411, and the lock mechanisms 600A.

The lock mechanism 600A includes the one-way gears 601, 601*a*, 602, and 602*a*, the one-way clutches 620, and the stopper rack 603. The one-way clutches 620 restrict relative rotations between the rotating shafts 410 and 411 and the one-way gears 601, 601*a*, 602, and 602*a* respectively.

The lock mechanism 600A regulates the rotations of the first and second rotating shafts 410 and 411 when the front-portion side regulating plate 1 is moved away from the regulated sheets. The lock mechanism 600A regulates the rotations of the first and second rotating shafts 410 and 411 when the front-portion side regulating plate 1 is moved in the direction in which the front-portion side regulating plate 1 contacts the regulated sheets.

Figure 12:
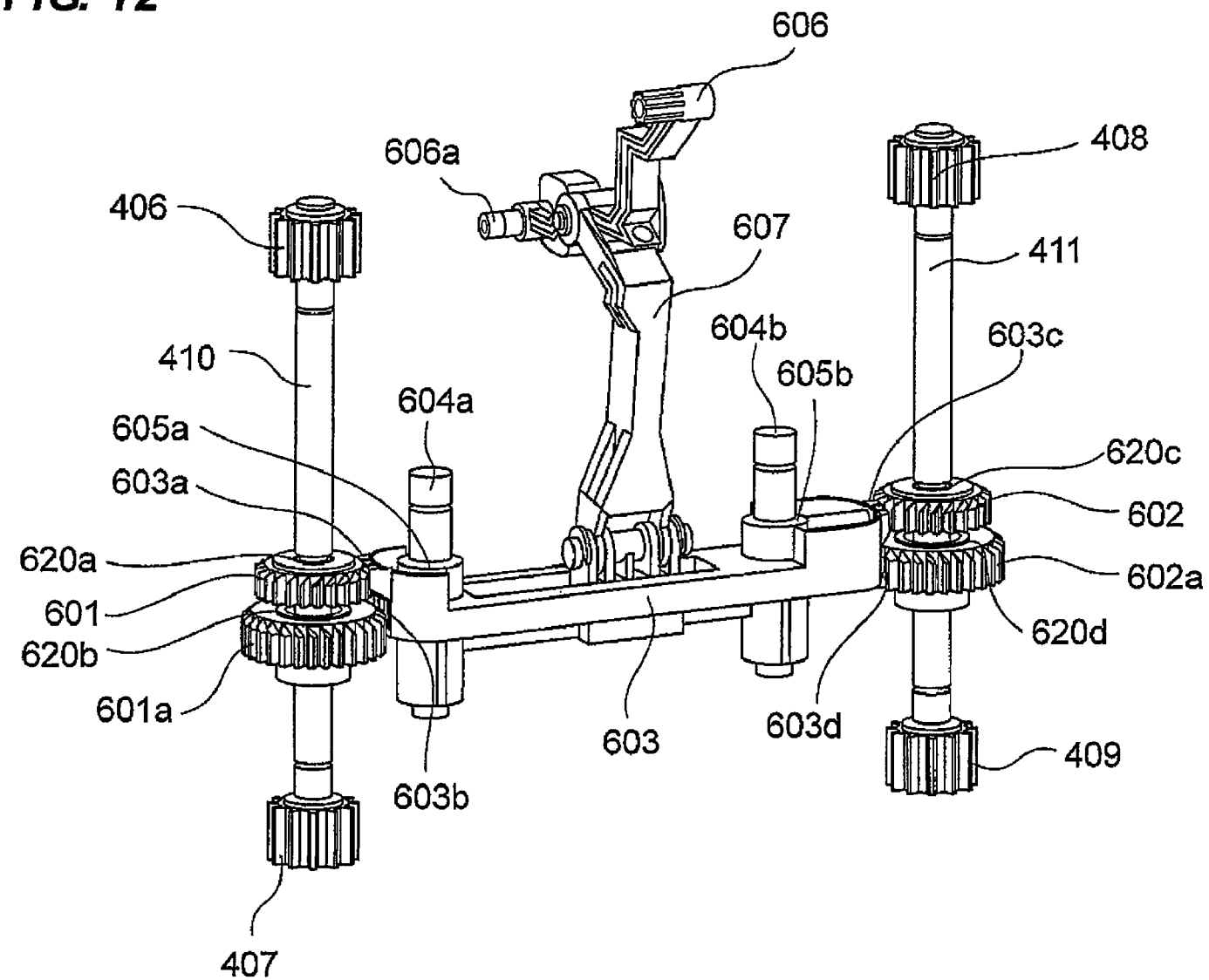
FIG. 12 illustrates a locked state of a fixing portion fixing the front-portion side regulating plate provided in the sheet storage portion.

When the side guide stopper knob 606 is turned downward, the stopper rack 603 is lowered, and the first and third one-way gears 601 and 601*a* engage the first and second rack portions 603*a* and 603*b* provided at one end of the stopper rack 603 as shown in FIG. 12. The second and fourth one-way gears 602 and 602*a* engage the third and fourth rack portions 603*c* and 603*d* provided at the other end of the stopper rack 603.

Figure 13:
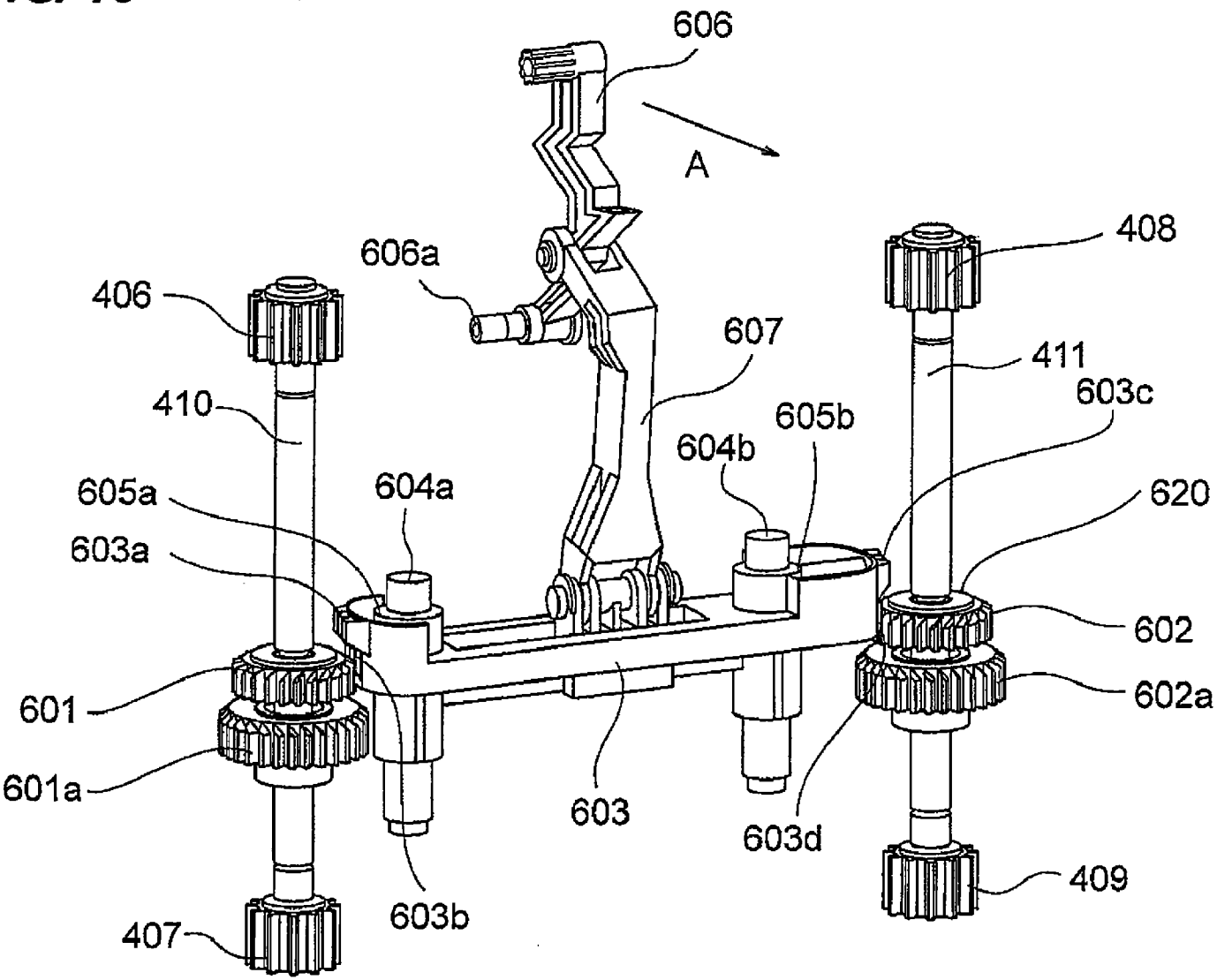
FIG. 13 is a first view illustrating an unlocked state of the fixing portion.
Figure 15:
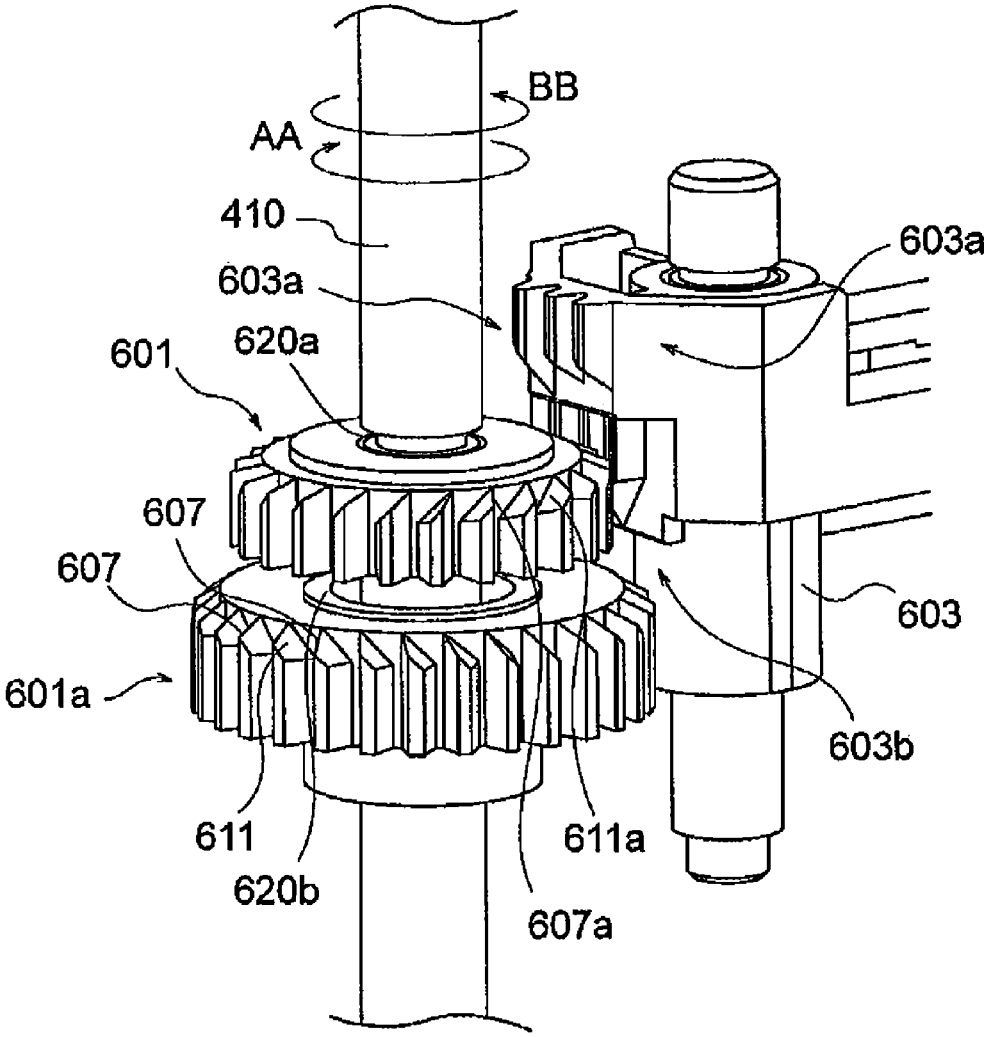
FIG. 15 is a perspective view illustrating first and third one-way gears and first and second rack portions of a stopper rack which constitute the fixing portion fixing the front-portion side regulating plate.

When the side guide stopper knob 606 is turned upward, the first and third one-way gears 601 and 601*a* disengage the first and second rack portions 603*a* and 603*b* of the stopper rack 603 as shown in FIGS. 13 and 15. The second and fourth one-way gears 602 and 602*a* disengage the third and fourth rack portion 603*c* and 603*d* of the stopper rack 603.

The operations of the front-portion and rear-portion side regulating plates 1 and 2 in storing the sheets having the larger sizes in the sheet storage portion 100 will be described below.

Figure 14:
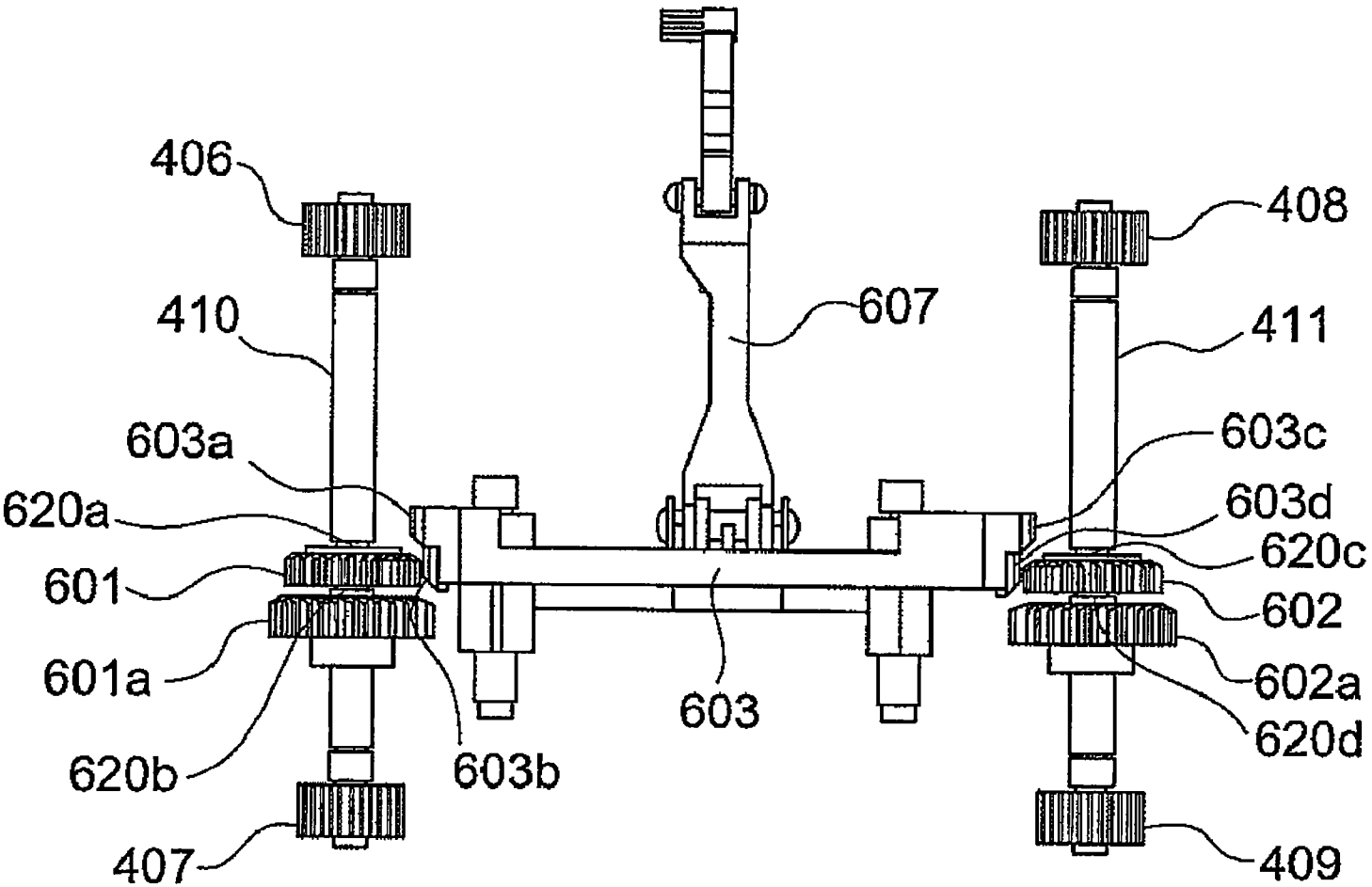
FIG. 14 is a second view illustrating the unlocked state of the fixing portion.

The operator lifts the side guide stopper knob 606 to perform the disengagement between the first to fourth one-way gears 601, 601*a*, 602, and 602*a* and the first to fourth rack portion 603*a* to 603*d* of the stopper rack 603 as shown in FIGS. 13 and 14. Then, the interval in the width direction between the front-portion and rear-portion side regulating plates 1 and 2 is set larger than the sheet width.

As shown in FIG. 11, the upper grip portion 415 is provided in the upper end portion of the front-portion side regulating plate 1, and the operator holds the upper grip portion 415 to move the front-portion side regulating plate 1 in the direction in which the distance with the rear-portion side regulating plate 2 is widened (direction in which the front-portion side regulating plate 1 is moved away from the sheet). At this point, the first and third rack gears 401 and 403 are moved with respect to the first and third pinion gears 406 and 408 located in the upper portions, thereby rotating the first and third pinion gears 406 and 408 in the directions of the arrows AA and DD respectively.

When the first and third pinion gears 406 and 408 are rotated in the directions of the arrows AA and DD respectively, the torques of the first and third pinion gears 406 and 408 are transmitted through the first and second rotating shafts 410 and 411, and therefore the second and fourth pinion gears 407 and 409 located in the lower portions are rotated to move the second and fourth rack gears 402 and 404 located in the lower portions. At this point, the first to fourth one-way gears 601, 601*a*, 602, and 602*a* are freely rotated according to the movements of the first and second rotating shafts 410 and 411.

The rack gear 412 shown in FIG. 6 is moved to rotate the pinion gear 413 according to the movement of the front-portion side regulating plate 1, and the rack gear 414 fixed to the rear-portion side regulating plate 2 is moved. Therefore, similarly the rear-portion side regulating plate 2 is moved outward.

Then, the operator sets the sheets, and the operator holds the upper grip portion 415 to inwardly move the front-portion side regulating plate 1 such that the front-portion side regulating plate 1 is fit to the sheet size. The movement of the upper portion moves the first and third rack gears 401 and 403 with respect to the first and third pinion gears 406 and 408 to rotate the first and third pinion gears 406 and 408 in the directions of the arrows BB and CC.

The rotations of the first and third pinion gears 406 and 408 in the directions of the arrows BB and CC rotate the second and fourth pinion gears 407 and 409 to move the second and fourth rack gears 402 and 404 located in the lower portions. At this point, the first to fourth one-way gears 601, 601*a*, 602, and 602*a* are freely rotated according to the movements of the first and second rotating shafts 410 and 411. Similarly the rear-portion side regulating plate 2 is moved inward according to the movement of the front-portion side regulating plate 1. After the front-portion side regulating plate 1 and the rear-portion side regulating plate 2 are moved to the positions corresponding to the sheet size, the side guide stopper knob 606 is turned downward such that the positions of the front-portion side regulating plate 1 and the rear-portion side regulating plate 2 are fixed.

Therefore, as shown in FIG. 12, the stopper rack 603 is lowered and the first to fourth rack portion 603*a* to 603*d* formed at both the ends of the stopper rack 603 engage the first to fourth one-way gears 601, 601*a*, 602, and 602*a*.

Because the stopper rack 603 is not moved in the width direction by the moving shafts 604*a* and 604*b*, the rotations of the first to fourth one-way gears 601, 601*a*, 602, and 602*a* are regulated when the first to fourth rack portion 603*a* to 603*d* engage the first to fourth one-way gears 601, 601*a*, 602, and 602*a*. That is, the first to fourth one-way gears 601, 601*a*, 602, and 602*a* are locked to regulate the rotations thereof.

When the third one-way gear 601*a* is rotated in the BB direction (first rotating shaft 410 is rotated in the AA direction) by the third one-way clutch 620*b*, the third one-way gear 601*a* is locked by the first rotating shaft 410. However, the rotation of the third one-way gear 601*a* is permitted in the AA direction. When the third one-way gear 601*a* is locked, the rotation of the first rotating shaft 410 is regulated by the action of the third one-way clutch 620*b* in the AA direction in which the front-portion side regulating plate 1 is moved away from the sheets.

When the fourth one-way gear 602*a* is rotated in the CC direction (second rotating shaft 411 is rotated in the DD direction) by the fourth one-way clutch 620*d*, the fourth one-way gear 602*a* is locked by the second rotating shaft 411. However, the rotation of the fourth one-way gear 602*a* is permitted in the DD direction. When the fourth one-way gear 602*a* is locked, the rotation of the second rotating shaft 411 is regulated by the action of the fourth one-way clutch 620*d* in the DD direction in which the front-portion side regulating plate 1 is moved away from the sheets.

That is, when the third and fourth one-way gears 601*a* and 602*a* engage the second and fourth rack portions 603*b* and 603*d* formed in the stopper rack 603, the rotations of the first and second rotating shafts 410 and 411 are regulated in the direction in which the front-portion side regulating plate 1 is moved away from the sheets. Therefore, even if the force acts on the front-portion side regulating plate 1 in the direction in which the distance with the rear-portion side regulating plate 2 is widened, the first and second rotating shafts 410 and 411 are not rotated, which allows the front-portion side regulating plate 1 to be slipped in the outside direction (A direction) in which the distance with the rear-portion side regulating plate 2 is widened.

When the first one-way gear 601 is rotated in the AA direction (first rotating shaft 410 is rotated in the BB direction) by the first one-way clutch 620*a*, the first one-way gear 601 is locked by the first rotating shaft 410. When the first one-way gear 601 is locked, the rotation of the first rotating shaft 410 is regulated by the action of the first one-way clutch 620*a* in the BB direction in which the front-portion side regulating plate 1 is moved to the sheet side. However, the rotation of the first one-way gear 602*a* is permitted in the BB direction.

When the second one-way gear 602 is rotated in the DD direction (second rotating shaft 411 is rotated in the CC direction) by the second one-way clutch 620*c*, the second one-way gear 602 is locked by the second rotating shaft 411. However, the rotation of the second one-way gear 602 is permitted in the CC direction. When the second one-way gear 602 is locked, the rotation of the second rotating shaft 411 is regulated by the action of the second one-way clutch 620*c* in the CC direction in which the front-portion side regulating plate 1 is moved to the sheet side.

That is, when the first and second one-way gears 601 and 602 engage the first and third rack portion 603*a* and 603*c* formed in the stopper rack 603, the rotations of the first and second rotating shafts 410 and 411 are regulated in the direction in which the front-portion side regulating plate 1 is moved to the sheet side. Therefore, even if the force acts on the front-portion side regulating plate 1 in the direction in which the distance with the rear-portion side regulating plate 2 is moved to the sheet side, the first and second rotating shafts 410 and 411 are not rotated, which allows the front-portion side regulating plate 1 to be slipped in the inside direction (opposite direction to the A direction) in which the distance with the rear-portion side regulating plate 2 is narrowed.

Thus, even if the sheet storage portion 100 in which the sheets are fully stacked is powerfully attached to the printer body 1001, the movements of the front-portion and rear-portion side regulating plates 1 and 2 caused by inertia of the sheets can be prevented by locking the front-portion side regulating plate 1.

In the case where the small amount of sheets is set, the movement of front-portion side regulating plate 1 caused by inertia of itself can be prevented when the sheet storage portion 100 is powerfully attached to the printer body 1001. The one-way clutches provided in the first to fourth one-way gears 601, 601*a*, 602, and 602*a* may be set to necessary torques in consideration of the above-described situation.

In the second embodiment, the first to fourth rack portion 603*a* to 603*d* of the stopper rack 603 engage the first to fourth one-way gears 601, 601*a*, 602, and 602*a* from above by the downward turning operation of the side guide stopper knob 606.

FIG. 15 illustrates the first and third one-way gears 601 and 601*a* and the first and second rack portion 603*a* and 603*b* of a stopper rack 603. The second and fourth one-way gears 602 and 602*a* and the third and fourth rack portion 603*c* and 603*d* of the stopper rack 603 have the same configurations.

In the case where the third one-way gear 601*a* engages the second rack portion 603*b* from above, when side faces of tooth surfaces of the third one-way gear 601*a* and second rack portion 603*b* are formed in flat shapes, the third one-way gear 601*a* does not engage the second rack portion 603*b* as long as phases of the third one-way gear 601*a* and second rack portion 603*b* are just matched with each other. The same holds true for the fourth one-way gear 602*a* and the fourth rack portion 603*d*.

Therefore, when the rack is inserted in the gear, usually the chevron inclinations whose tops are located in the center lines of the cogs are provided in the third one-way gear 601*a* and second rack portion 603*b*. However, depending on the phase during the engagement, sometimes the third one-way gear 601*a* can engage the second rack portion 603*b* when the third one-way gear 601*a* is rotated in the AA direction, or sometimes the third one-way gear 601*a* can engage the second rack portion 603*b* when the third one-way gear 601*a* is rotated in the BB direction.

At this point, although only the third one-way gear 601*a* is rotated in the AA direction by the action of the third one-way clutch 620*b*, the third one-way gear 601*a* is rotated in the BB direction while being integral with the first rotating shaft 410 due to the action of the third one-way clutch 620*b*.

In this case, the first and second pinion gears 406 and 407 engaging the first rotating shaft 410 and the first and second rack gears 401 and 402 are moved, and the front-portion side regulating plate 1 is moved onto the sheet side, whereby the third one-way gear 601*a* can be rotated. A large force is required to move the first rotating shaft 410, the first and second pinion gears 406 and 407, the first and second rack gears 401 and 402, and the front-portion side regulating plate 1.

However, the force cannot be generated by the side guide stopper knob 606. When the chevron inclinations whose tops are located in center lines of the cogs are provided in the third one-way gear 601*a* and second rack portion 603*b*, sometimes the third one-way gear 601*a* and the second rack portion 603*b* cannot engage each other depending on the phases of the third one-way gear 601*a* and second rack portion 603*b*.

In the second embodiment, the third one-way gear 601*a* is always rotated in the AA direction when engaging the second rack portion 603*b* of the stopper rack 603. The fourth one-way gear 602*a* is always rotated in the DD direction when engaging the fourth rack portion 603*d*.

Therefore, as shown in FIG. 15, the cog of the third one-way gear 601*a* is inclined so as to become higher toward the AA direction in which the one-way clutch 620*b* regulates the rotation of the first rotating shaft 410, and the cog of the third one-way gear 601*a* is inclined such that the edge line 607 becomes highest in the tooth surface in the circumferential direction. The inclined surface 611 is provided in the AA direction on the rack portion side (lock member side) of the cog of the third one-way gear 601*a* 1 such that the downstream side in the AA direction becomes higher, i.e., such that the inclined surface 611 is inclined while orientated toward the rack portion side.

Figure 16:
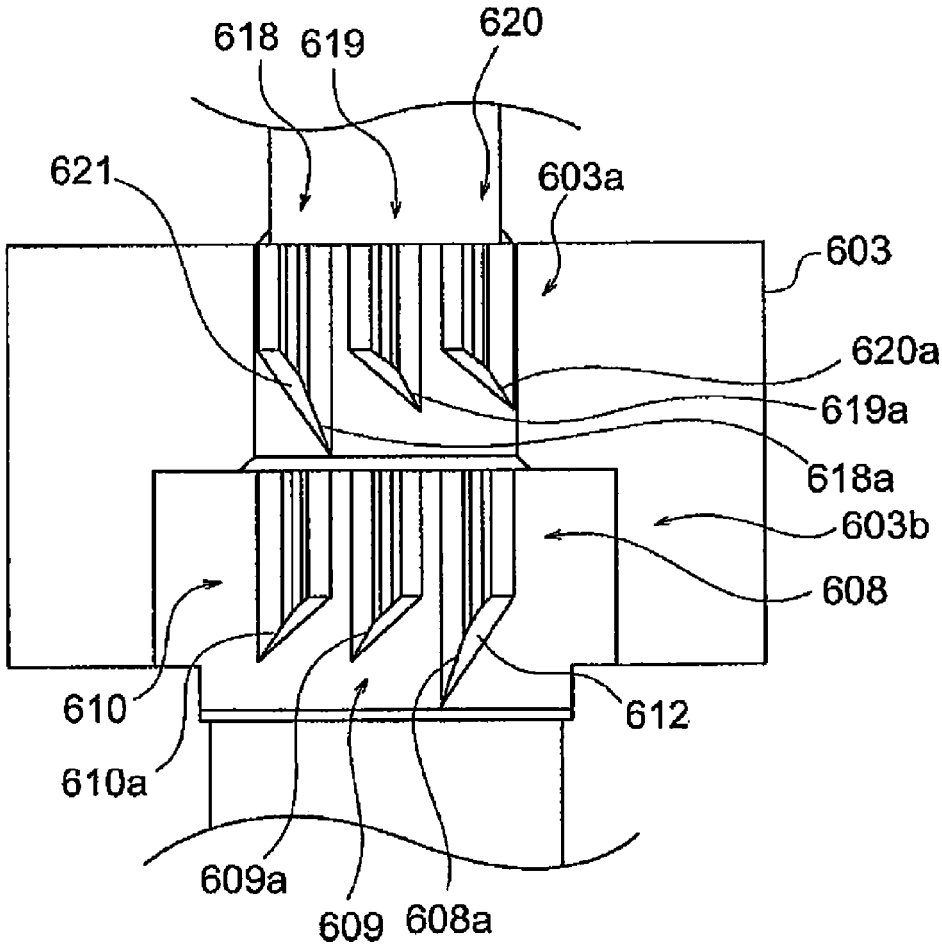
FIG. 16 is a side view illustrating the first and second rack portions of the stopper rack.

As shown in FIG. 16, vertically-extended three (plural) cogs are provided in the second rack portion 603*b* to ensure the fixing force. In the three cogs, the central cog 609 is referred to as second cog, the cog 608 located on the downstream side in the AA direction of the second cog 609 is referred to as first cog, and the cog 610 located on the upstream side in the AA direction of the second cog 609 is referred to as third cog.

The first to third cogs 608, 609, and 610 are formed such that the edge lines 608*a*, 609*a*, and 610*a* become lowest in the circumferential direction about the first rotating shaft 410. That is, the inclined surfaces 612 are provided on the third one-way gear side (lock gear side) of the first to third cogs 608, 609, and 610. The inclined surface 612 is provided such that the downstream side in the AA direction becomes higher.

The relationship between the third one-way gear 601*a* and the second rack portion 603*b* is similarly to that of FIG. 9. That is, when the inclination of the edge line 610*a* of the third cog 610 is larger than the inclination of the edge line 607*a* of the third one-way gear 601*a*, sometimes the rotation of the third one-way gear 601*a* in the AA direction is obstructed by the base side (lower end side) of the edge line 610*a*. Therefore, in the second embodiment, the inclination of the edge line 610*a* of the third cog 610 is formed larger than the inclination of the edge line 607*c*.

When the inclination of the edge line 608*a* of the first cog 608 is smaller than the inclination of the edge line 607*c* of the third one-way gear 601*a*, sometimes the rotation of the third one-way gear 601*a* in the AA direction is obstructed by the upper end side of the edge line 608*a*. Therefore, in the second embodiment, the inclination of the edge line 608*a* of the first cog 608 is formed larger than the inclination of the edge line 607*c* as shown in FIG. 10.

Even if the phases of the cogs of the third one-way gear 601*a* and second rack portion 603*b* are shifted from each other, the third one-way gear 601*a* can be rotated in the AA direction to engage the second rack portion 603*b*.

On the other hand, when the first one-way gear 601 engages first rack portion 603*a*, depending on the phases during the engagement, sometimes the engagement can be performed when the first one-way gear 601 is rotated in the AA direction, and sometimes the engagement can be performed when the first one-way gear 601 is rotated in the BB direction.

As described above, although only the first one-way gear 601 is rotated in the AA direction only by the action of the first one-way clutch 620*a*, the large force is required for the rotation of the first one-way gear 601 in the BB direction.

Therefore, in the second embodiment, the first one-way gear 601 is always rotated in the AA direction when the first one-way gear 601 engages the first rack portion 603*a* of the stopper rack 603. Similarly the second one-way gear 602 is always rotated in the DD direction.

In the second embodiment, as shown in FIG. 15, the cog of the first one-way gear 601 becomes higher toward the BB direction, and the edge line 607*a* is inclined so as to become highest in the circumferential direction of the tooth surface.

That is, the inclined surface 611*a* is provided on the rack portion side (lock member side) of the cog of the first one-way gear 601. The inclined surface 611*a* is provided such that the downstream side in the BB direction becomes higher.

As shown in FIG. 16, the vertically-extended three (plural) cogs are provided in the rack portion 603*a* to ensure the fixing force. In the three cogs, a central cog 619 is referred to as second cog, a cog 618 located on the downstream side in the BB direction of the second cog 619 is referred to as first cog, and a cog 620 located on the upstream side in the BB direction of the second cog 619 is referred to as third cog.

The first to third cogs 618, 619, and 620 are formed such that edge lines 618*a*, 619*a*, and 620*a* become lowest in the circumferential direction about the first rotating shaft 410. That is, inclined surfaces 621 are provided on the first one-way gear sides (lock gear sides) of the first to third cogs 618, 619, and 620. The inclined surface 612 is provided such that the downstream side in the BB direction becomes higher.

Figure 17:
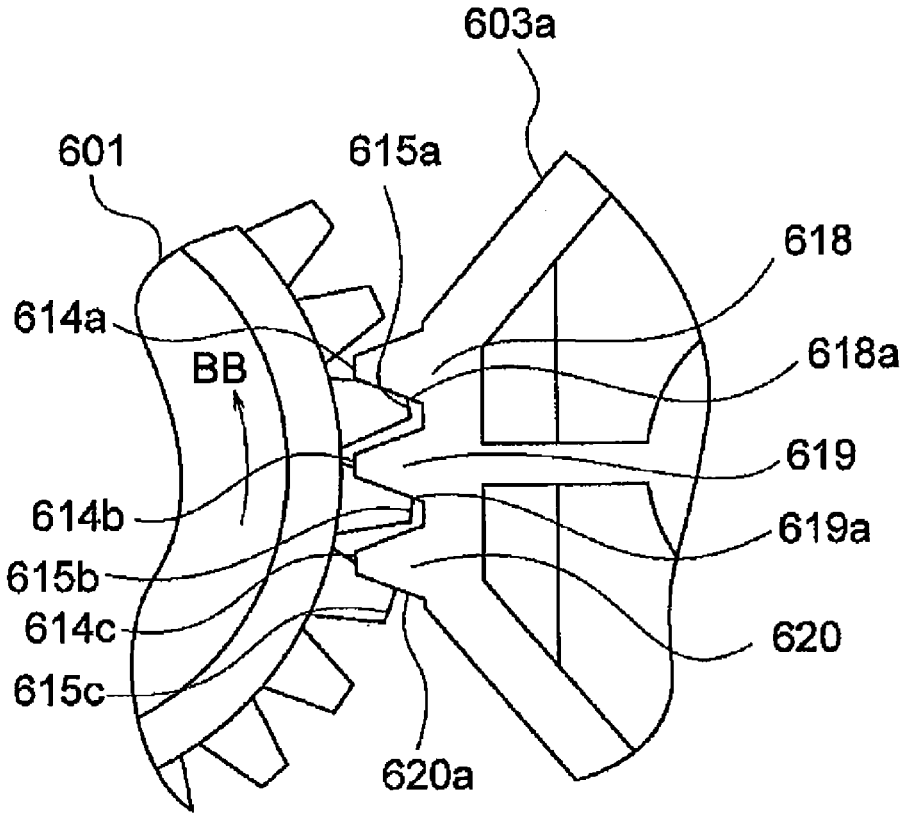
FIG. 17 is a top view illustrating the first one-way gear and the first rack portion of the stopper rack.
Figure 18:
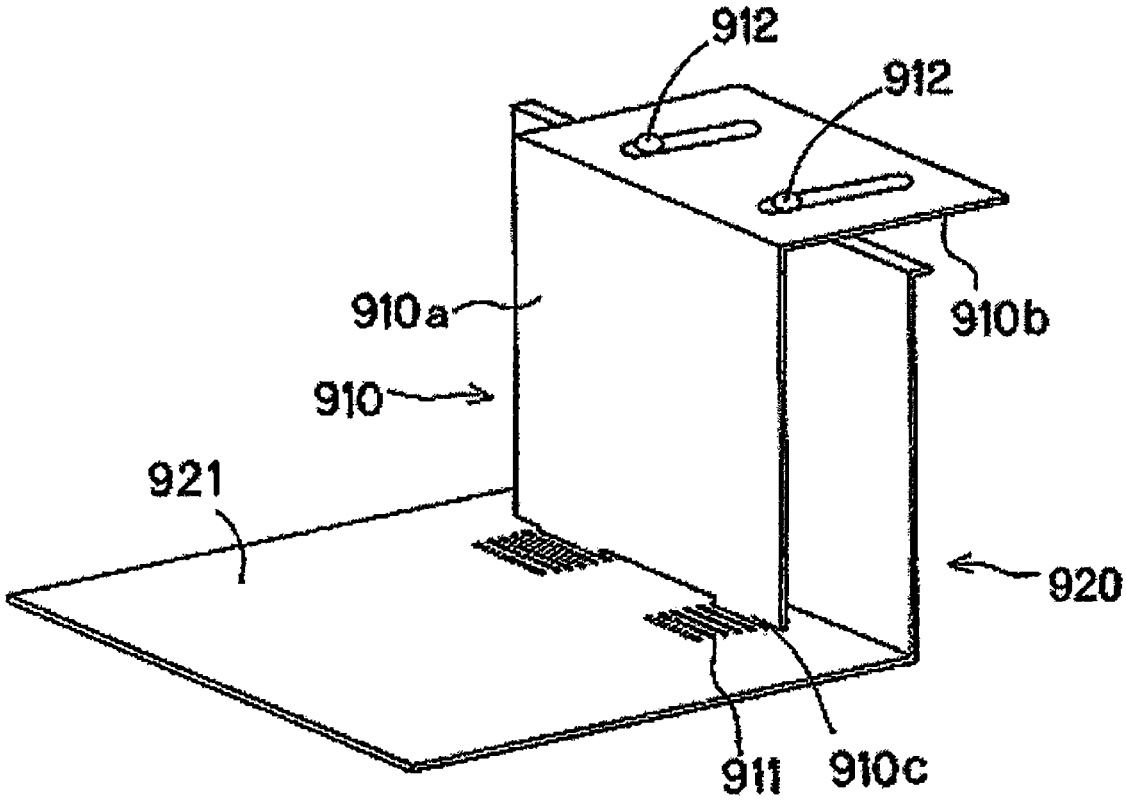
FIG. 18 PRIOR ART
FIG. 18 illustrates a configuration of a conventional side-end regulating member.

FIG. 17 is a top view illustrating the first one-way gear 601 and the first rack portion 603*a*. FIG. 17 illustrates the state in which the cogs of the first one-way gear 601 abut on the cogs of the rack portion 603*a* while the phases are shifted from each other.

In FIG. 17, the edge line 618*a*, 619*a*, and 620*a* illustrate not the surface viewed from above but the inclined surface. FIG. 17 also illustrates the edge lines 614*a* to 614*c*, 615*a* to 615*c* of the cogs of the first one-way gear 601. In the case where the cogs are shifted from each other, when the inclination of the edge line 620*a* is larger than the inclination of the edge line 614*c* in causing the edge line 614*c* of the cog of the first one-way gear 601 to abut on the edge line 620*a* of the third cog 620 of the first rack portion 603*a*, the rotation of the first one-way gear 602 in the BB direction is obstructed by the base side of the edge line 620*a*.

When the inclination of the edge line 618*a* is smaller than the inclination of the edge line 614*c* in causing the edge line 614*c* of the cog of the first one-way gear 601 to abut on the edge line 618*a* of the first cog 618 of the first rack portion 603*a*, the rotation of the first one-way gear 602 in the BB direction is obstructed by the front end side of the edge line 618*a*.

Therefore, in the second embodiment, the inclination of the edge line 618*a* of the first cog 618 of the first rack portion 603*a* is formed larger than the inclination of the edge line 614*a* of the cog of the first one-way gear 601. As shown in FIG. 17, in the edge lines 618*a*, 619*a*, and 620*a* of the first to third cogs 618 to 620 of the first rack portion 603*a*, first the edge line 618*a* of the first cog 618 abuts on the edge line 614*a* of the one-way gear 602.

Even if the phases of the cogs of the first one-way gear 601 and first rack portion 603*a* are shifted from each other, the first one-way gear 601 can be rotated in the AA direction to engage the first rack portion 603*a*.

As a result, the side guide stopper knob 606 is turned downward by the small force, i.e., the force with which only the one-way gear 610 is slightly rotated (up to one cog), which allows the front-portion side regulating plate 1 to substantially be locked without looseness. The second and fourth one-way gears 602 and 602*a* and the third and fourth rack portions 603*c* and 603*d* have the same configurations.

Thus, in the second embodiment, when the first to fourth rack portion 603*a* to 603*d* engage the first to fourth one-way gears 601, 601*a*, 602, and 602*a*, the one-way clutch 620 can regulate the rotations of the first and second rotating shafts 410 and 411. That is, the lock mechanism 600A can regulate the rotations of the first and second rotating shafts 410 and 411 associated with the movement of the front-portion side regulating plate 1 (and rear-portion side regulating plate 2).

Therefore, the movements of the front-portion side regulating plate 1 (and rear-portion side regulating plate 2) in both the direction in which the front-portion side regulating plate 1 is moved away from the regulated sheet and the direction in which the front-portion side regulating plate 1 contacts the regulated sheet can be regulated, so that the front-portion side regulating plate 1 (and rear-portion side regulating plate 2) can securely be fixed without generating the lateral slip of the sheet. Even a person with weak power can stably obtain large lock force without losing an operational feeling while the sheet is not laterally slipped. Then, a second embodiment of the invention will be described.

In the second embodiment, the gears of the third and fourth one-way gears 601*a* and 602*a* located in the lower portion having the diameters larger than those of the first and second one-way gears 601 and 602 located in the upper portion.

The one-way gears 601*a* and 602*a* having the larger diameters are located in the lower portion, whereby the movement of the stopper rack 605 can be suppressed to the minimum when the stopper rack 605 is moved upward from the locked state shown in FIG. 12 to the unlocked state shown in FIGS. 13 and 14. Accordingly the miniaturization of the printer 1000 can be achieved.

In the above embodiments, the sheet feeder apparatus 1002 has the configuration in which the sheet is fed by the roller. However, for example, the invention can also be applied to the sheet feeder apparatus having the configuration in which the sheet is fed by air. In the above embodiments, the front-portion and rear-portion side regulating plates are simultaneously moved. However, the invention can also be applied to the case in which the movable side regulating plate is disposed only on the single side.

In the above embodiments, the front-portion side regulating plate is locked. Alternatively, the rear-portion side regulating plate may be locked, or both the front-portion and rear-portion side regulating plates may be fixed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-105365, filed Apr. 12, 2007, which is hereby incorporated by reference herein in its entirety.

What is claimed is:

1. An image forming apparatus comprising a sheet feeder apparatus including a sheet storage portion, the sheet storage portion including a regulating member and a fixing portion, the regulating member being provided to be able to be moved in a width direction orthogonal to a sheet feeding direction, the regulating member regulating a position of a sheet in the width direction, the fixing portion fixing the regulating member to a position according to a size of the sheet, the sheet feeder apparatus feeding the sheet regulated by the regulating member, wherein the fixing portion includes:

a plurality of rack gears which are provided on a surface opposite a surface abutting on the sheet of the regulating member, the rack gears extended in a moving direction of the regulating member;

a plurality of relay gears which engage the plurality of rack gears respectively;

a rotating shaft on which the plurality of relay gears are provided; and a lock mechanism which has a lock gear which is provided on the rotating shaft, a lock member which has a gear portion, the gear portion engaging the lock gear to fix the lock gear; and a one-way clutch which restricts relative rotation between the rotating shaft and the lock gear, and the lock mechanism regulates rotation of the rotating shaft when the regulating member is moved away from the regulated sheet, the lock mechanism permitting the rotation of the rotating shaft when the regulating member is moved in a direction in which the regulating member contacts the regulated sheet.

2. The image forming apparatus according to claim 1, wherein the one-way clutch permits rotation of the lock gear when the lock gear is rotated in a direction in which the rotation of the rotating shaft is regulated, and the one-way clutch regulates the rotation of the lock gear when the lock gear is rotated in a direction in which the rotation of the rotating shaft is permitted.

3. The image forming apparatus according to claim 1, wherein the lock member is moved in an axial direction of the rotating shaft to perform engagement and disengagement between the gear portion and the lock gear.

4. The image forming apparatus according to claim 3, wherein an inclined surface is provided on a lock member side of a cog of the lock gear, the inclined surface being inclined in a direction in which the one-way clutch regulates the rotation of the rotating shaft and in a direction in which the rotating shaft is brought close to the lock member side, and an inclined surface is provided on a lock gear side of a cog of the gear portion of the lock member, the inclined surface being inclined in a direction in which the rotation of the rotating shaft is regulated and in a direction in which the rotating shaft is moved away from the lock gear.

5. The image forming apparatus according to claim 1, wherein a gear portion of the lock member includes a plurality of cogs.

6. The image forming apparatus according to claim 5, wherein an edge line of an inclined surface of a cog on a downstream side in the direction in which the rotation of the rotating shaft in the gear portion of the lock member is regulated is located closer to the lock gear than edge lines of inclined surfaces of other cogs in the gear portion of the lock member, and an angle formed by the edge line of the cog on the downstream side of the lock member and a plane in which a rotation center of the lock gear is set to a normal line is larger than an angle formed by the edge line of the inclined surface of the cog of the lock gear and the plane in which the rotation center of the lock gear is set to the normal line.

* * * * *